US010080467B2

(12) United States Patent
Ciavarella et al.

(10) Patent No.: US 10,080,467 B2
(45) **Date of Patent: *Sep. 25, 2018**

(54) FOAM DISPENSING SYSTEMS, PUMPS AND REFILL UNITS HAVING HIGH AIR TO LIQUID RATIOS

(71) Applicant: GOJO Industries, Inc., Akron, OH (US)

(72) Inventors: Nick E. Ciavarella, Seven Hills, OH (US); Jacob Twaroski, Wattsburg, PA (US); Dennis K. Jenkins, Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/356,795

(22) Filed: Nov. 21, 2016

(65) Prior Publication Data

US 2017/0143172 A1 May 25, 2017

Related U.S. Application Data

(63) Continuation-in-part of application No. 15/355,112, filed on Nov. 18, 2016.
(Continued)

(51) Int. Cl.
*A47K 5/14* (2006.01)
*B05B 7/00* (2006.01)
(Continued)

(52) U.S. Cl.
CPC ..... *A47K 5/14* (2013.01); *B05B 7/0018* (2013.01); *B05B 7/0416* (2013.01);
(Continued)

(58) Field of Classification Search
CPC ... A47K 5/12; A47K 5/14; A47K 5/16; B05B 11/3087; B05B 7/0018; F04B 13/02;
(Continued)

(56) References Cited

U.S. PATENT DOCUMENTS 3,937,364 A 2/1976 Wright
3,970,219 A 7/1976 Spitzer
(Continued)

FOREIGN PATENT DOCUMENTS

CN 202370781 U 8/2012
CN 202493407 U 10/2012
(Continued)

OTHER PUBLICATIONS

Office Action for U.S. Appl. No. 15/355,112 dated Dec. 29, 2017.
(Continued)

*Primary Examiner* — Patrick M Buechner
(74) *Attorney, Agent, or Firm* — Calfee, Halter & Griswold LLP

(57) ABSTRACT

An exemplary foam dispenser system includes a housing, a container, a motor, an air pump, a foam pump, a first mixing chamber, a second mixing chamber, a foam cartridge, and an outlet for dispensing foam. The container holds a foamable liquid. The foam pump has a liquid pump portion that pumps liquid, and an air pump portion that pumps air. The first mixing chamber is located downstream of the liquid pump portion and the air pump portion, and the liquid and the air mix in the first mixing chamber to create a first foam mixture. The second mixing chamber is located downstream of the first mixing chamber and the air pump, and the first mixture and air from the air pump mix in the second mixing chamber to create a second foam mixture. The second foam mixture travels through the foam cartridge and exits the outlet as rich foam.

20 Claims, 16 Drawing Sheets

Related U.S. Application Data

(60) Provisional application No. 62/258,173, filed on Nov. 20, 2015, provisional application No. 62/263,349, filed on Dec. 4, 2015, provisional application No. 62/293,931, filed on Feb. 11, 2016, provisional application No. 62/319,061, filed on Apr. 6, 2016.

(51) Int. Cl.

| | |
|---|---|
| ***B05B 12/12*** | (2006.01) |
| ***B05B 7/24*** | (2006.01) |
| ***B05B 7/04*** | (2006.01) |
| ***F04B 43/02*** | (2006.01) |
| ***F04B 45/04*** | (2006.01) |
| ***F04B 23/04*** | (2006.01) |
| ***F04B 19/06*** | (2006.01) |

(52) U.S. Cl.
CPC ..... *B05B 7/2402* (2013.01); *B05B 12/122* (2013.01); *F04B 19/06* (2013.01); *F04B 23/04* (2013.01); *F04B 43/02* (2013.01); *F04B 45/04* (2013.01); *F04B 45/041* (2013.01)

(58) Field of Classification Search
CPC .. F04B 43/0045; F04B 43/025; F04B 43/026; F04B 43/04; F04B 53/10; F04B 43/02; F04B 45/042; F04B 7/0038; F04B 7/0233; F04B 7/0275
See application file for complete search history.

(56) References Cited

U.S. PATENT DOCUMENTS 4,022,351 A 5/1977 Wright
4,044,923 A 8/1977 Gardner
4,049,830 A 9/1977 Pugliese
4,184,615 A 1/1980 Wright
4,219,159 A * 8/1980 Wesner ..... B05B 7/0062 239/343
4,274,594 A 6/1981 Ito
4,371,517 A 2/1983 Vanlerberghe
4,678,668 A 7/1987 Darras
4,801,249 A 1/1989 Kakizawa
4,940,702 A 7/1990 Finch
4,945,110 A 7/1990 Brokken
5,028,407 A 7/1991 Finch
5,063,249 A 11/1991 Andrews
5,129,550 A 7/1992 Eschbach
5,208,257 A 5/1993 Kabara
5,370,815 A 12/1994 Kessler
5,529,770 A 6/1996 McKinzie
5,534,266 A 7/1996 Ricketts
5,575,993 A 11/1996 Ward
5,616,348 A 4/1997 Winicov
5,635,469 A 6/1997 Fowler
5,720,984 A 2/1998 Ricketts
5,791,882 A 8/1998 Stucker et al.
5,842,607 A 12/1998 Snider
5,843,912 A 12/1998 Hosmane
5,967,202 A 10/1999 Mullen
6,082,586 A 7/2000 Banks
6,264,438 B1 7/2001 Fukami
6,302,058 B1 10/2001 Dahl
6,382,928 B1 5/2002 Chang
6,544,539 B1 4/2003 Ricketts
6,871,679 B2 3/2005 Last
7,040,876 B2 5/2006 Fukami et al.
7,451,687 B2 11/2008 Lynn
7,647,954 B2 1/2010 Garber et al.
7,850,049 B2 12/2010 Ciavarella et al.
7,887,304 B2 2/2011 Cal
8,272,539 B2 9/2012 Ophardt et al.
8,276,784 B2 10/2012 Ciavarella
8,304,375 B1 11/2012 Wolff
8,449,267 B2 5/2013 Pascual
8,544,698 B2 10/2013 Ciavarella et al.
8,734,132 B2 5/2014 Brender a Brandis
8,763,863 B2 7/2014 Quinlan et al.
8,820,585 B1 9/2014 Banks
8,845,309 B2 9/2014 Cal
8,955,718 B2 2/2015 Ciavarella et al.
8,960,498 B2 2/2015 Weglin et al.
9,341,176 B2 5/2016 Itahara
2002/0051717 A1 5/2002 Fukami
2003/0031571 A1 2/2003 Yamakawa
2003/0068234 A1 4/2003 Shindo
2003/0068242 A1 4/2003 Yamakawa
2004/0266649 A1 12/2004 Thekkekandam
2005/0049513 A1 3/2005 Hori
2005/0258192 A1 11/2005 Matthews
2006/0281663 A1 12/2006 Asmus
2007/0148101 A1 6/2007 Snyder
2007/0237901 A1 10/2007 Moses
2008/0051314 A1 2/2008 Wenzel
2009/0200340 A1* 8/2009 Ophardt ..... A47K 5/16 222/190
2009/0294478 A1* 12/2009 Ciavarella ..... A47K 5/14 222/190
2009/0317270 A1* 12/2009 Reynolds ..... A47K 5/1208 417/410.1
2010/0051642 A1* 3/2010 Wong ..... A47K 5/16 222/52
2010/0102083 A1* 4/2010 Quinlan ..... A47K 5/16 222/52
2010/0270328 A1* 10/2010 Quinlan ..... A47K 5/16 222/1
2012/0285992 A1 11/2012 Ciavarella et al.
2012/0309660 A1 12/2012 Kawasoe
2012/0315166 A1 12/2012 Looi et al.
2013/0017110 A1* 1/2013 Villagomez ..... F04B 43/02 417/559
2013/0032614 A1* 2/2013 Babikian ..... B01F 5/0693 222/190
2013/0056497 A1 3/2013 McNulty
2013/0165530 A1 6/2013 Hillman
2013/0175296 A1 7/2013 Gray
2013/0200098 A1 8/2013 Li
2013/0206794 A1 8/2013 McNulty et al.
2013/0233441 A1 9/2013 Ciavarella
2014/0054322 A1 2/2014 McNulty et al.
2014/0054323 A1 2/2014 McNulty et al.
2014/0061246 A1 3/2014 McNulty
2014/0117053 A1 5/2014 Ciavarella
2014/0154117 A1 6/2014 Fukami
2014/0189992 A1 7/2014 Ganzeboom
2014/0203047 A1 7/2014 McNulty
2014/0234140 A1 8/2014 Curtis et al.
2014/0243417 A1 8/2014 Modak
2014/0367419 A1 12/2014 Harris et al.
2015/0025156 A1 1/2015 Hillman
2015/0080478 A1 3/2015 Cohen
2015/0090737 A1* 4/2015 Ciavarella ..... A47K 5/1211 222/190
2015/0209811 A1 7/2015 Ophardt et al.
2015/0251841 A1 9/2015 McNulty et al.
2015/0266657 A1 9/2015 Corney
2015/0297728 A1 10/2015 Charboneau
2015/0320266 A1 11/2015 Creaghan
2015/0337820 A1 11/2015 Cai
2016/0029855 A1 2/2016 Harris et al.
2016/0256016 A1 9/2016 Yang
2017/0135531 A1 5/2017 Mak

FOREIGN PATENT DOCUMENTS

CN 203570550 U 4/2014
CN 203867833 U 10/2014
CN 204003387 U 12/2014
EP 2135538 A1 12/2009
EP 3064114 A1 9/2016

(56) References Cited

FOREIGN PATENT DOCUMENTS

| | | | |
|---|---|---|---|
| TW | 375133 | U | 3/2010 |
| WO | 2012154642 | A1 | 11/2012 |
| WO | 2013126696 | A2 | 8/2013 |

OTHER PUBLICATIONS

Office Action for U.S. Appl. No. 15/369,007 dated Dec. 29, 2017.
Notice of Allowance for U.S. Appl. No. 15/530,185 dated Dec. 13, 2017.
Office Action for U.S. Appl. No. 15/530,190 dated Dec. 18, 2017.
Notice of Allowance for U.S. Appl. No. 15/355,112 dated May 21, 2018.
Notice of Allowance for U.S. Appl. No. 15/369,007 dated May 22, 2018.
Notice of Allowance for U.S. Appl. No. 15/350,190 dated May 8, 2018.
Office Action for U.S. Appl. No. 15/429,389 dated Feb. 23, 2018.
Office Action for U.S. Appl. No. 15/480,711 dated Mar. 28, 2018.

* cited by examiner

FOAM DISPENSING SYSTEMS, PUMPS AND REFILL UNITS HAVING HIGH AIR TO LIQUID RATIOS

RELATED APPLICATIONS

The present invention claims priority to, and the benefits of: U.S. Provisional Application Ser. No. 62/258,173 filed on Nov. 20, 2015 and titled FOAM DISPENSING SYSTEMS, PUMPS AND REFILL UNITS HAVING HIGH AIR TO LIQUID RATIOS; U.S. Provisional Application Ser. No. 62/263,349 filed on Dec. 4, 2015 and titled SEQUENTIALLY ACTIVATED MULTI-DIAPHRAGM FOAM PUMPS, REFILL UNITS AND DISPENSER SYSTEMS; U.S. Provisional Application Ser. No. 62/293,931 filed on Feb. 11, 2016 and titled HIGH QUALITY NON-AEROSOL HAND SANITIZING FOAM; U.S. Provisional Application Ser. No. 62/319,061 filed on Apr. 6, 2016 and titled SEQUENTIALLY ACTIVATED MULTI-DIAPHRAGM FOAM PUMPS, REFILL UNITS AND DISPENSER SYSTEMS; and U.S. Non-Provisional patent application Ser. No. 15/355,112 filed on Nov. 18, 2016 and titled SEQUENTIALLY ACTIVATED MULTI-DIAPHRAGM FOAM PUMPS, REFILL UNITS AND DISPENSER SYSTEMS. Each of which are incorporated herein by reference in their entirety.

TECHNICAL FIELD

The present invention relates generally to pumps, refill units for foam dispenser systems, and more particularly to sequentially activated multi-diaphragm foam pumps for mixing liquid soap, sanitizer, or lotion with air to create and dispense a foam product.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles. Typical foam dispensers for dispensing foams have an air to liquid ration of about 7 to 1.

SUMMARY

The present application discloses exemplary embodiments of sequentially activated multi-diaphragm foam pumps and dispenser systems having sequentially activated multi-diaphragm foam pumps.

An exemplary foam dispenser system includes a housing, a container, a motor, an air pump, a foam pump, a first mixing chamber, a second mixing chamber, a foam cartridge, and an outlet for dispensing foam. The container holds a foamable liquid. The foam pump has a liquid pump portion that pumps liquid, and an air pump portion that pumps air. The first mixing chamber is located downstream of the liquid pump portion and the air pump portion, and the liquid and the air mix in the first mixing chamber to create a first foam mixture. The second mixing chamber is located downstream of the first mixing chamber and the air pump, and the first mixture and air from the air pump mix in the second mixing chamber to create a second foam mixture. The second foam mixture travels through the foam cartridge and exits the outlet as rich foam.

Another exemplary foam dispenser includes a housing, a receptacle for receiving a refill unit, a motor, an air pump drive, a permanent air pump having an air pump outlet, a foam pump drive, and a removable foam pump. The air pump drive drives the permanent air pump. The foam pump drive drives the removable foam pump. The removable foam pump is removable and is part of the refill unit. The removable foam pump includes a plurality of diaphragm pump chambers. At least one diaphragm pump chamber pumps liquid, and at least two diaphragm pump chambers pump air.

Another exemplary foam dispenser includes a housing, a motor, an air pump secured to the housing, and a refill unit. The air pump has an air pump outlet. The refill unit has a container for holding foamable liquid, a foam pump, a first mixing chamber, a second mixing chamber, a foam cartridge, and an outlet. The foam pump has a liquid pump portion that pumps liquid and an air pump portion that pumps air. The first mixing chamber is located downstream of the liquid pump portion and the air pump portion, and the liquid and the air mix in the first mixing chamber to create a first foam mixture. The refill unit is releasably attachable to the air pump in a manner that allows the air pump outlet to be in fluid communication with the second mixing chamber of the refill unit. The second mixing chamber is located downstream of the first mixing chamber, and the first foam mixture mixes with air in the second mixing chamber to create a second foam mixture. The second foam mixture travels through the foam cartridge and exits the outlet as rich foam.

An exemplary refill unit for a foam dispenser includes a container for holding foamable liquid, a foam pump, a first mixing chamber, a second mixing chamber, an air inlet into the second mixing chamber for receiving air from a second air pump secured to a dispenser, and a foam pump drive connector. The foam pump has a liquid pump portion that pumps liquid and an air pump portion that pumps air. The first mixing chamber is located downstream of the liquid pump portion and the air pump portion, and liquid and air mix in the first mixing chamber to create a first foam mixture. The second mixing chamber is located downstream of the first mixing chamber, and the second mixing chamber receives the first foam mixture. The air inlet into the second mixing chamber receives compressed air from the second air pump that is secured to the dispenser to mix with the first foam mixture. When the refill unit is installed in the dispenser, the air inlet is in fluid communication with the second air pump. When the refill unit is removably installed in the dispenser, the foam pump drive connector is coupled to a motor that is permanently secured to the foam dispenser and rotation of the motor drives the foam pump.

Another exemplary foam dispenser includes a housing, an air pump secured to the housing and a motor secured to the housing. A replaceable refill unit may be inserted in the housing. The replaceable refill unit includes a container for holding foamable liquid and a foam pump secured to the container. The foam pump has a liquid pump portion that pumps liquid and an air pump portion that pumps air. The refill unit includes a mixing chamber for mixing the liquid and air pumped from the foam pump on the refill unit with air pumped from the air pump that is secured to the housing. The refill unit also includes a foam cartridge and an outlet for dispensing foam.

An exemplary foam dispenser for dispensing foam having an air to liquid ratio of greater than about 15 to 1 includes a housing, a motor located within the housing, a holder for retaining a container with a foamable liquid and a foam pump. The foam pump has a liquid pump diaphragm, and at least three air pump diaphragms. A mixing chamber is located downstream of the liquid pump diaphragm and the at least three air pump diaphragms. The foam pump also includes an outlet. The liquid pump diaphragm and the at least three air pump diaphragms are operated sequentially.

DETAILED DESCRIPTION

Figure 1:
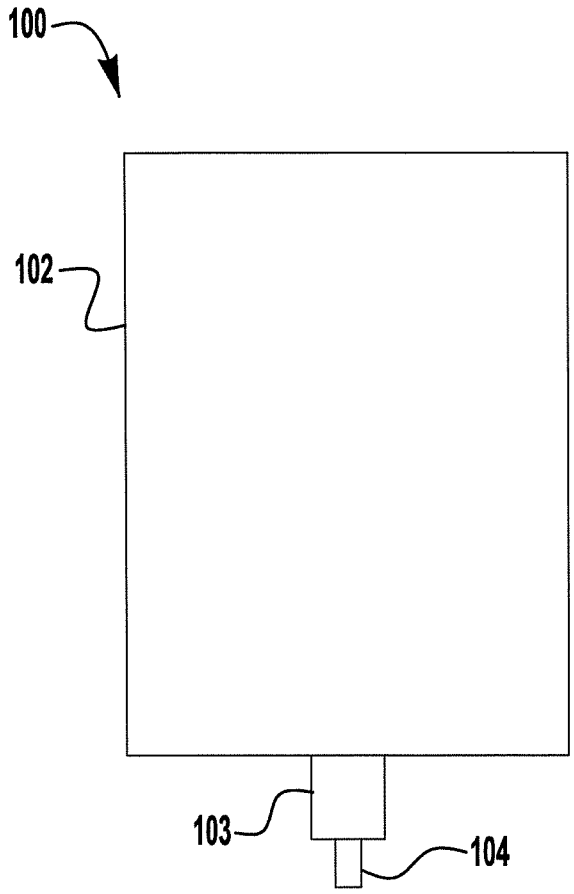
FIG. 1 is an exemplary embodiment of a refill unit for a foam dispenser.

The present application discloses exemplary embodiments of multi-diaphragm foam pumps. Some exemplary embodiments operated the multi-diaphragm foam pumps sequentially. Some exemplary embodiments include a foam pump and an air pump. Some exemplary embodiments include a sequentially activated multi-diaphragm foam pump and a sequentially activated multi-diaphragm air pump. Some exemplary embodiments include a wobble plate and three or more pump diaphragms. The three or more pump diaphragms include at least one liquid pump diaphragm and at least two air pump diaphragms. Each liquid pump diaphragm has a liquid inlet for receiving concentrated liquid, such as, for example, a soap, a sanitizer, or a lotion, and each air pump diaphragm has an air inlet for receiving a gas, such as, for example, ambient air. The three or more pump diaphragms operate sequentially, and each pump diaphragm operates once in an operating cycle. An exemplary operating cycle begins with the operation of a liquid pump diaphragm. Additionally, the sequentially activated multi-diaphragm foam pump includes a mixing chamber. Each liquid pump diaphragm pumps liquid into the mixing chamber, and each air pump diaphragm pumps ambient air into the mixing chamber.

The liquid mixes with the ambient air in the mixing chamber to create a foam mixture that is dispensed out of the pump outlet. In some embodiments, the foam mixture has an air to liquid ratio of greater than about 5 to 1. In some embodiments, the air to liquid ratio is greater than about 7 to 1, and in some embodiments, the air to liquid ration is greater than about 10 to 1. In exemplary embodiments that have a single foam pump, the liquid to air ratio may be greater than about 10 to 1, greater than about 15 to 1, greater than about 20 to 1, or even greater than 20 to 1.

In some exemplary embodiments, a flow control valve (not shown) is located between the container of foamable liquid and the pump to adjust the liquid to air ratio. If a higher liquid to air ratio is desired, the flow control valve is set at a lower flow rate that starves the liquid pump diaphragm. Conversely, to increase the liquid to air ratio, the flow control valve may be opened wider allowing more liquid to flow into pump. In some embodiments, the liquid pump diaphragm may have a different volume than the air pump diaphragms to adjust the ratio of liquid to air. In some embodiments, the volume of the liquid pump diaphragm is reduced by inserting a sponge (not shown) in the liquid pump diaphragm. Not only does the sponge (not shown) reduce the volume, but in some embodiments, slows the flow of liquid through the liquid pump diaphragm. In some embodiments, the sponge increases the expansion rate of the liquid pump diaphragm allowing it to re-prime faster.

In some exemplary embodiments, a second air pump and second mixing chamber are included. In some embodiments, these components are part of a disposable refill unit. Air an liquid pumped from the sequentially activated multi-diaphragm foam pump flows through the first mixing chamber flow into the second mixing chamber. Air from the second air pump is pumped into the second mixing chamber to mix with the foam mixture and dispensed. In these exemplary embodiments, the air to liquid ratio is greater than about 20 to 1. In some embodiments, the air to liquid ratio is greater than about 30 to 1, and in some embodiments is greater than about 40 to 1 and in some embodiments is about 50 to 1. In some embodiments, the second air pump is a sequentially activated multi-diaphragm air pump.

The sequentially activated multi-diaphragm foam pumps may be used in foam dispensers. An exemplary foam dispenser comprises a housing, a motor, a refill unit, a sequentially activated multi-diaphragm foam pump, and a foam cartridge. The pump receives a foamable liquid from the refill unit, mixes the foamable liquid with air to create a foam mixture, forces the foam mixture through the foam cartridge to enrich the foam, and dispenses the foam to a user. Some exemplary foam dispensers include a second air pump and a second mixing chamber which increases the ratio of air to liquid. In some embodiments, the addition of the second mixing chamber and/or the directions at which air from the second air pump and the liquid/air mixture from the first pump violently mixes up the mixture and enhances the foam.

FIG. 1 illustrates an exemplary refill unit 100 for an exemplary foam dispenser. The refill unit 100 includes a collapsible container 102. Collapsible container 102 includes a neck 103 and a drip-free quick connector 104. Exemplary drip-free quick connectors are disclosed in U.S. Pat. No. 6,871,679 titled Bag and Dispensing System Comprising Such A Bag, and U.S. Pat. No. 7,647,954 titled Connector Apparatus And Method For Connecting The Same For Controlling Fluid Dispensing, which are incorporated herein by reference in their entirety. Disposable refill units contain a supply of a foamable liquid. In various embodiments, the contained foamable liquid could be for example a soap, a sanitizer, a cleanser, a disinfectant, a lotion or the like. The container may be a non-collapsing container formed by a rigid housing member, or any other suitable configuration for containing the foamable liquid without leaking. In the case of a non-collapsing container, a vent system may be included. Exemplary venting systems are disclosed in U.S. Patent Applications Publication No. 2015/0266657 titled Closed system for venting a dispenser reservoir; Publication No. 2015/025184 titled Pumps With Container Vents and application Ser. No. 14/811,995, titled Vented Refill Units And Dispensers Having Vented Refill Units, which are incorporated herein by reference, in their entirety. In other embodiments, the container is a collapsible container and can be made of thin plastic or a flexible bag-like material.

Figure 2:
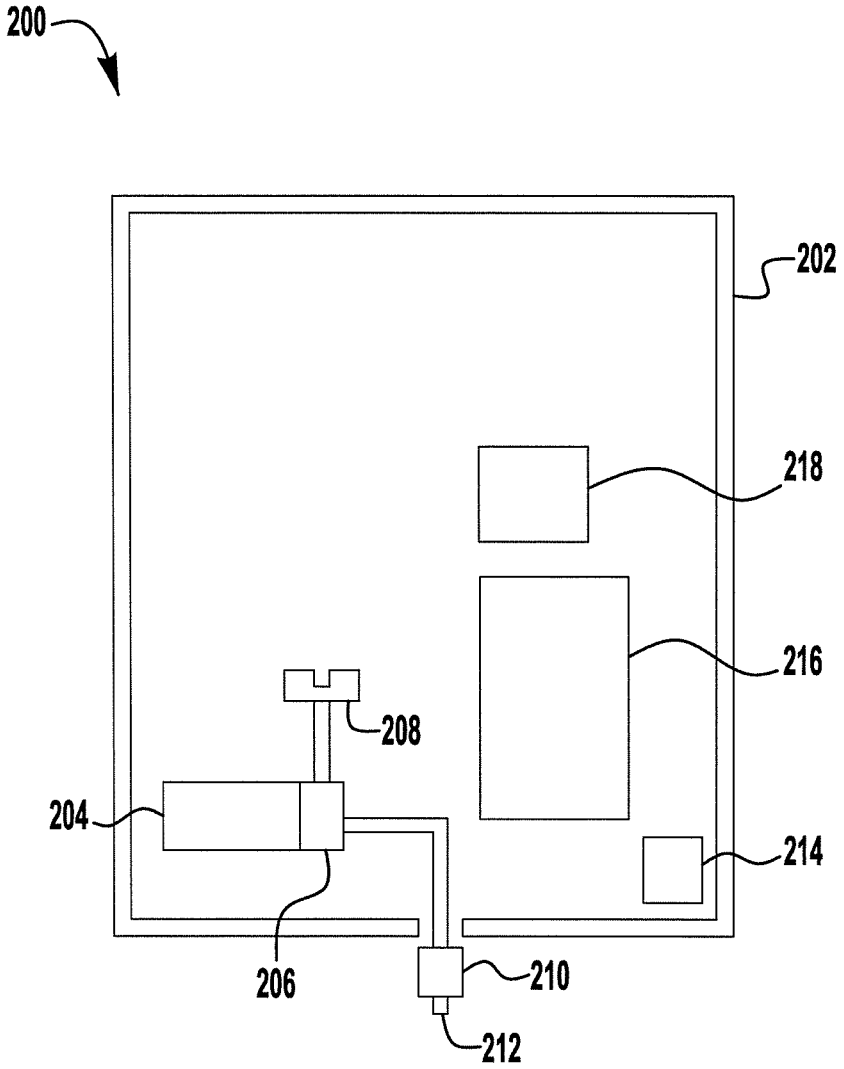
FIG. 2 is an exemplary embodiment of a foam dispenser.
Figure 2A:
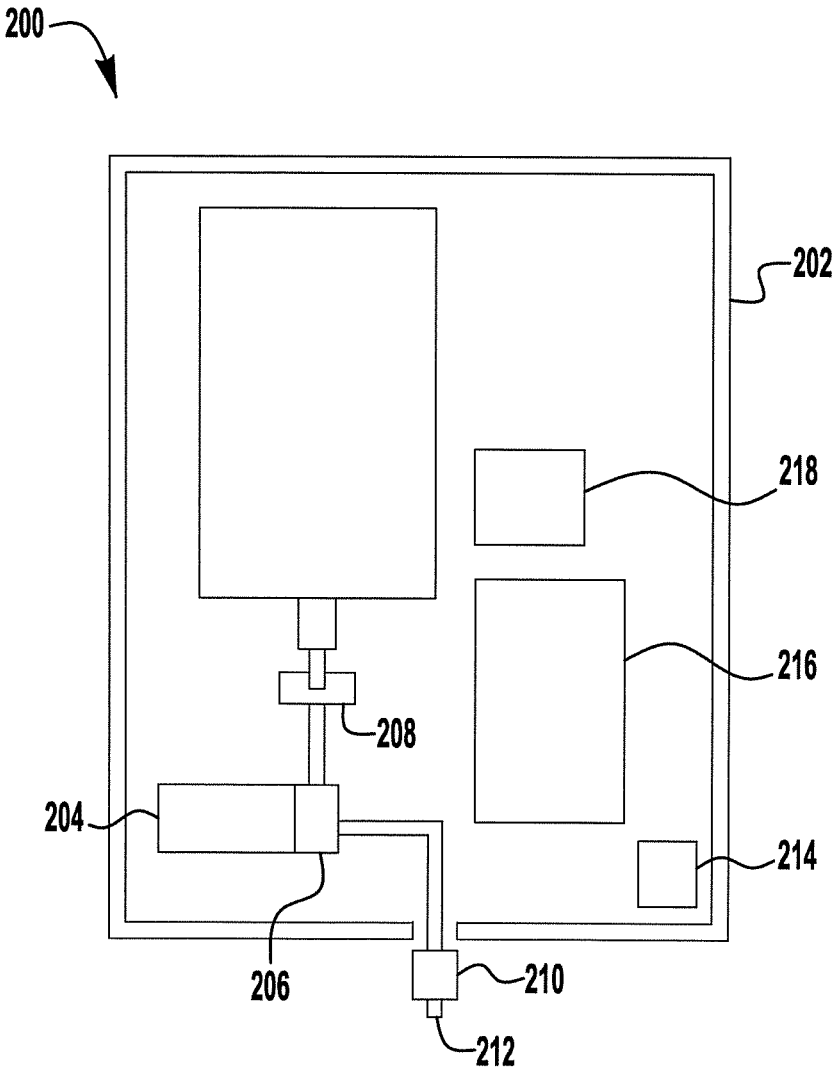
FIG. 2A is the exemplary foam dispenser of FIG. 2 with the exemplary refill unit of FIG. 1 installed.

FIG. 2 illustrates an exemplary embodiment of a touch-free foam dispenser 200. The touch-free foam dispenser 200 includes a housing 202, a motor 204, a foam pump 206, a refill unit connector 208, a foam cartridge 210, and a nozzle 212. Exemplary embodiments of foam cartridges 210 are shown and described below with respect to FIG. 13. A refill unit 100 may be connected to the refill unit connector 208 as shown in FIG. 2A. The refill unit 100 contains a foamable liquid, such as a soap, a sanitizer, a lotion, a cleanser, a disinfectant or the like. The touch-free foam dispenser 200 is activated when sensor 214 detects the presence of a user or object. Upon detection of an object or user, the sensor 214 provides a signal to the processor (not shown) in the electronic control board 216. The electronic control board 216 provides an output signal that causes the motor 204 to rotate an eccentric wobble plate actuator drive mechanism 301. The sensor 214 and the electronic control board 216 receive power from a power source 218. In some embodiments, the motor 204 receives power from the power source 218, and, in other embodiments, the refill unit includes a power source (not shown) that provides power to a rechargeable power source (not shown). Exemplary embodiments of refill units with power supplies that provide power to the wobble plate actuator drive mechanism 301 are shown and described in U.S. Publication No. 2014/0234140 titled Power Systems For Touch Free Dispensers And Refill Units Containing A Power Source, which is incorporated herein in its entirety by reference. Providing power to the motor 204 causes wobble plate actuator drive mechanism 301 to rotate. Rotation of wobble plate actuator drive mechanism 301 sequentially compresses and expands the diaphragms of foam pump 206 and pumps liquid and ambient air into mixing chamber 325. The liquid and air mix together and form a foam mixture. The foam mixture is forced through the foam cartridge 210, which creates a rich foam. The rich foam is dispensed from the foam dispenser 200 through the nozzle 212.

The refill unit 100 and the foam dispenser 200 illustrated in FIGS. 1 and 2, respectively, are drawn generically because a variety of different components may be used for many of the refill unit 100 and the foam dispenser 200. Although foam pump 206 is illustrated generically above, it is described in detail below. Some exemplary dispenser components that may be used in accordance with the present invention are shown and described in U.S. Pat. No. 8,960,498 titled Touch-Free Dispenser With Single Cell Operation And Battery Banking; U.S. Pat. Pub. No. 2014/00543.22 titled Off-Axis Inverted Foam Dispensers And Refill Units and Pub. No. 2014/0234140 titled Power Systems For Touch Free Dispensers And Refill Units Containing A Power Source, which are incorporated herein by reference in their entirety.

Figure 3:
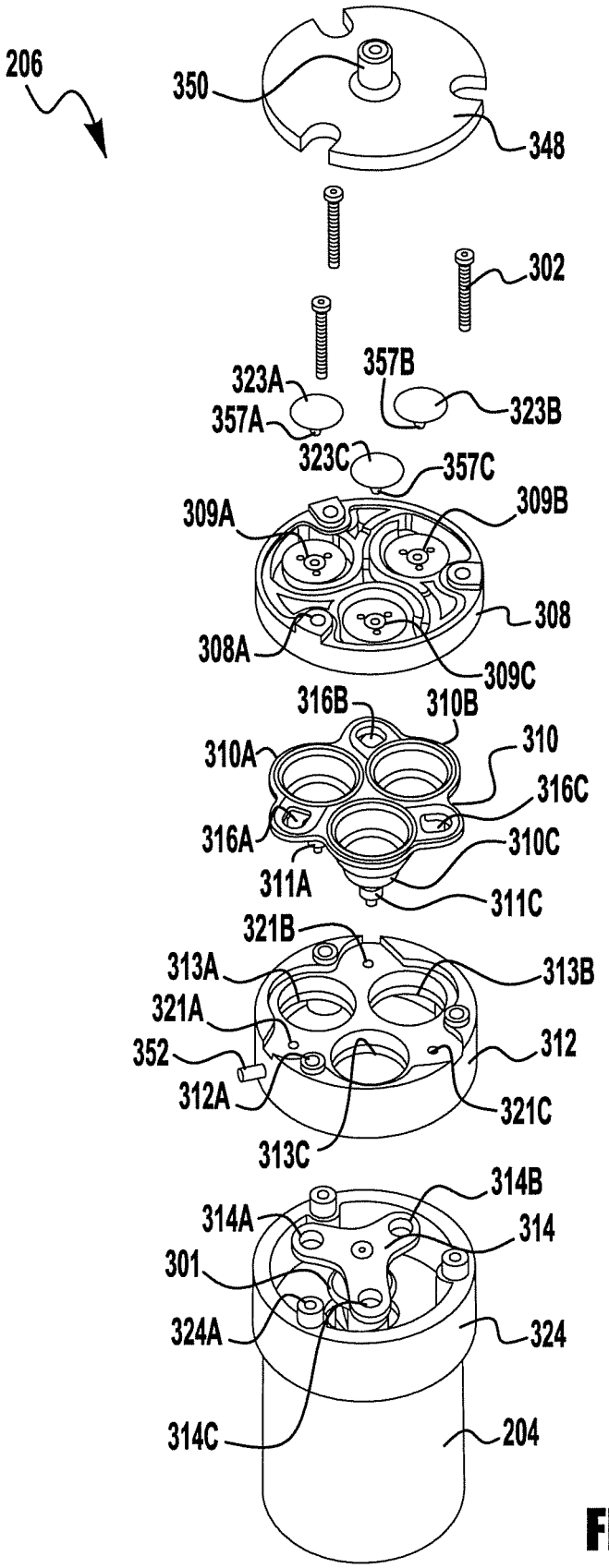
FIG. 3 is an exploded view of an exemplary embodiment of a sequentially activated multi-diaphragm foam pump taken from a first perspective.

FIG. 3 is an exploded view of an exemplary embodiment of foam pump 206. Foam pump 206 is driven by motor 204. Foam pump 206 includes a pump base 324, a wobble plate 314, a diaphragm assembly seat 312, a diaphragm assembly 310, a valve seat 308, outlet valves 323A, 323B, 323C, screws 302, and a cover 348. The valve seat 308, diaphragm assembly seat 312, and pump base 324 are secured together by screws 302 in screw holes 308A, 312A, 324A. The cover 348 is attached to the valve seat 308. Outlet valves 323A, 323B 323C are secured to and seated in the valve seat 308.

The diaphragm assembly 310 includes three pump diaphragms 310A, 310B, 310C, and each pump diaphragm 310A, 310B, 310C has a connector 311A, 311B, 311C. The diaphragm assembly 310 is located in the diaphragm assembly seat 312. The pump diaphragms 310A, 310B, 310C are disposed in the receiving holes 313A, 313B, 313C of the diaphragm assembly seat 312, and the three connectors 311A, 311B, 311C connect to the wobble plate 314 by inserting the three connectors 311A, 311B, 311C in the three wobble plate holes 314A, 314B, 314C.

Ambient air enters the foam pump 206 through pump air inlet 424B (FIG. 4), and liquid, such as for example, foamable soap or sanitizer enters the foam pump 206 through liquid inlet 352. Two of the pump diaphragms 310B, 310C receive ambient air, and the other pump diaphragm 310A receives foamable liquid, such as, for example soap or sanitizer.

Figure 4:
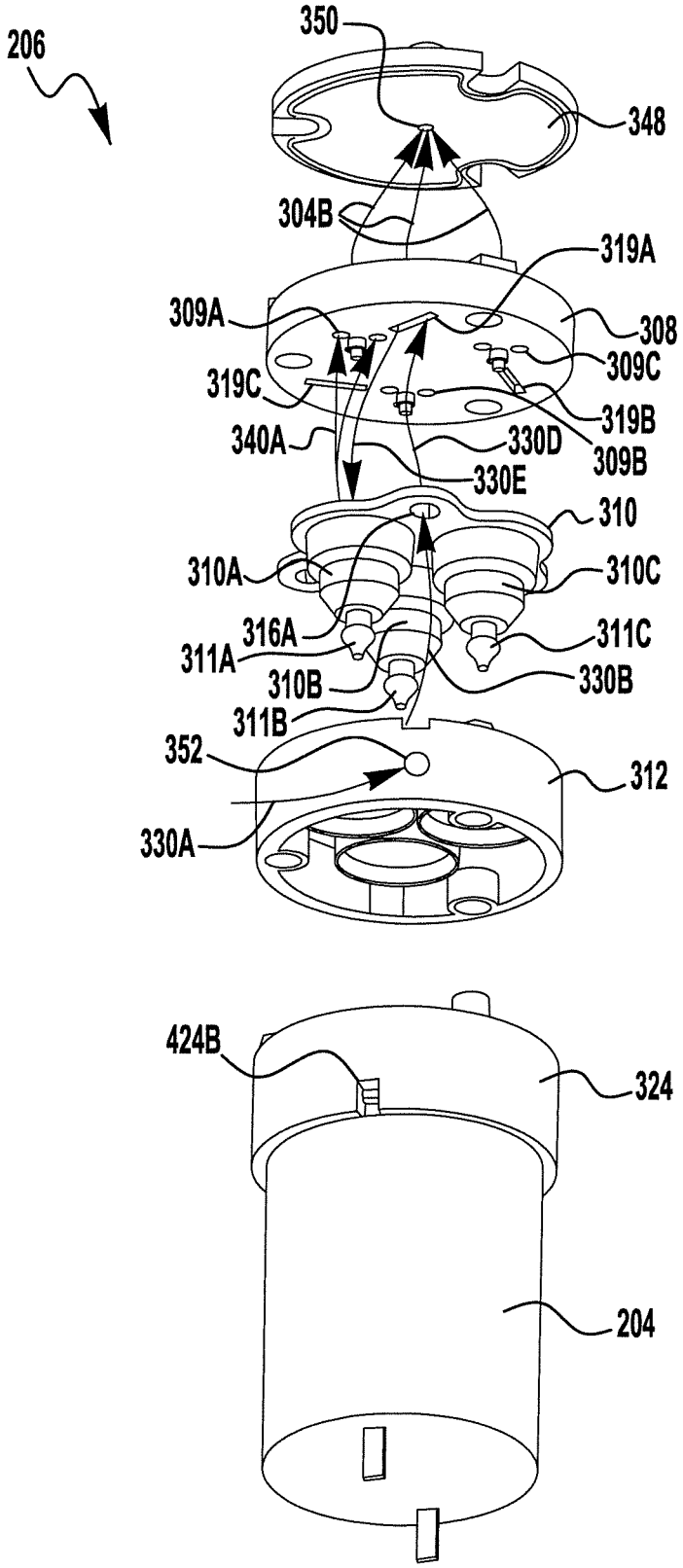
FIG. 4 is an exploded view of the exemplary embodiment of the sequentially activated multi-diaphragm foam pump of FIG. 3 taken from a second perspective.

FIG. 4 is another exploded view of the exemplary foam pump 206 from a different perspective. As described above, the diaphragm assembly 310 includes three pump diaphragms 310A, 310B, 310C. Each pump diaphragm 310A, 310B, 310C has a corresponding inlet valve 316A, 316B, 316C (better seen in FIGS. 5 and 6). FIG. 4 also provides a view of the bottom of the valve seat 308. The bottom of valve seat 308 has three areas that correspond to the three pump diaphragms 310A, 310B, 310C. Each area has three fluid outlet apertures 309A, 309B, 309C that extend through valve seat 308, a valve stem retention aperture 329A, 329B, 329C (FIG. 7), and a fluid inlet groove 319A, 319B, 319C. The fluid inlet grooves 319A, 319B, 319C do not extend through valve seat 308.

Figure 5:
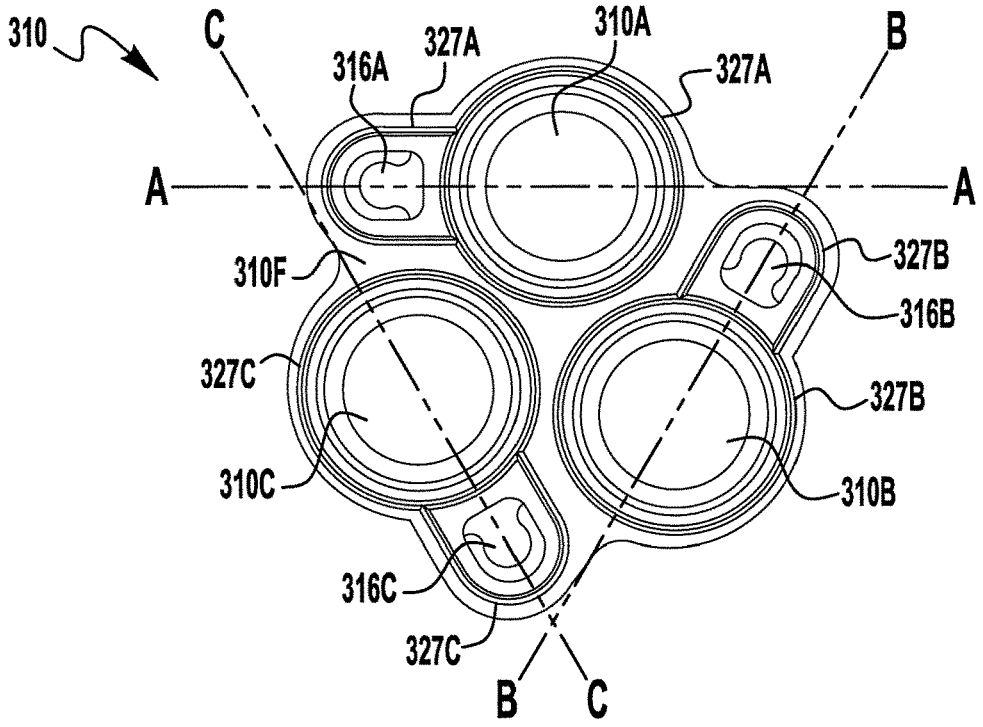
FIG. 5 is a top view of an exemplary diaphragm assembly for the exemplary embodiment of the sequentially activated multi-diaphragm foam pump of FIG. 3.
Figure 6:
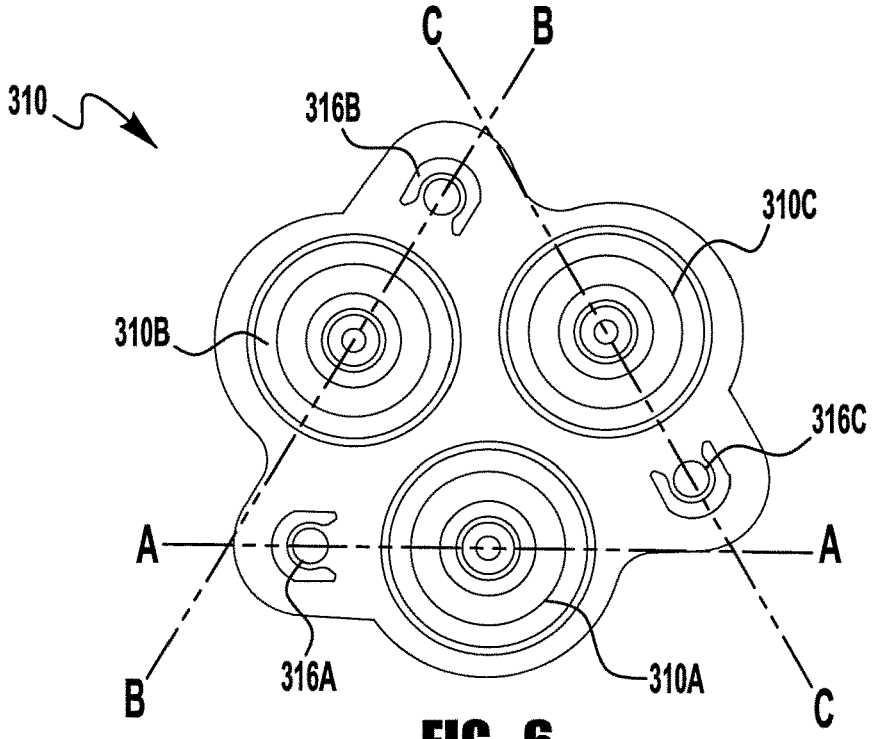
FIG. 6 is a bottom view of the exemplary diaphragm assembly of FIG. 5.

FIGS. 5 and 6 illustrate a top view and a bottom view, respectively, of the exemplary diaphragm assembly 310 for foam pump 206. In some embodiments, the diaphragm assembly is made of natural rubber, EPDM, Silicone, Silicone rubber TPE, TPU, TPV, vinyl, or the like. The diaphragm assembly 310 includes three molded pump diaphragms 310A, 310B, 310C and three corresponding inlet valves 316A, 316B, 316C. The top of the diaphragm assembly 310 acts as a sealing gasket. The top of the diaphragm assembly 310 has a flat section 310F, and each pump diaphragm 310A, 310B, 310C has gasket walls 327A, 327B, 327C that surround the respective valves 316A, 316B, 316C and pump diaphragms 310A, 310B, 310C. The gasket walls 327A, 327B, 327C seal against the bottom of the valve seat 308 (FIG. 4 and FIG. 8) to prevent fluid, such as, air and liquid soap or sanitizer from leaking out of the foam pump 206 at a location other than the pump outlet 350 (FIG. 3). One-way inlet valves 316A, 316B, 316C allow ambient air, liquid soap, or sanitizer to enter the pump diaphragms 310A, 310B, 310C when the pump diaphragms 310A, 310B, 310C have a negative pressure (i.e., when the pump diaphragms 310A, 310B, 310C are expanding), and seal against inlet apertures 321A, 321B, 321C when the pump diaphragms 310A, 310B, 310C have a positive pressure (e.g. when the pump diaphragms 310A, 310B, 310C are compressing). The one-way inlet valves 316A, 316B, 316C are formed by flexible tabs and are made of the same material as the diaphragm assembly 310.

Figure 7:
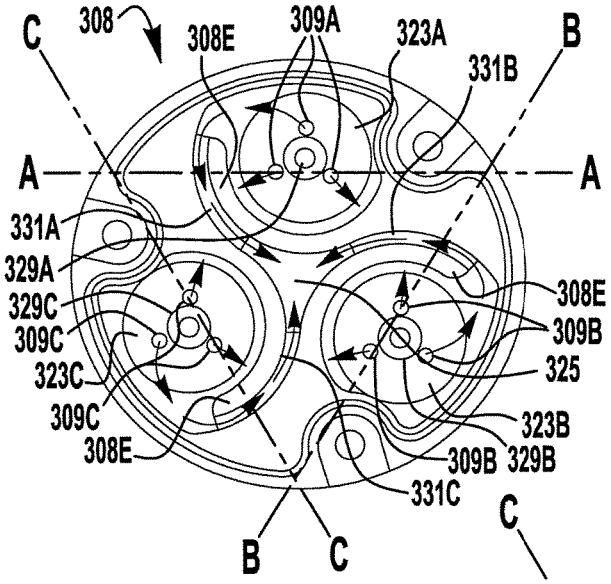
FIG. 7 is a top view of an exemplary valve seat for the exemplary embodiment of the sequentially activated multi-diaphragm foam pump of FIG. 3.

FIG. 7 is a top view of an exemplary valve seat 308 for the foam pump 206. One-way liquid outlet valve 323A is shown transparently to more clearly illustrate the flow of liquid 331A through liquid outlet apertures 309A and into mixing chamber 325. One-way liquid outlet valve 323A includes a valve stem 357A (FIG. 3) that is inserted into aperture 329A to secure one-way liquid outlet valve 323A to valve seat 308. One-way liquid outlet valve 323A is normally closed and prevents air or liquid from flowing from the mixing chamber 325, back through liquid outlet apertures 309A, and into liquid pump diaphragm 310A. One-way liquid outlet valve 323 opens when liquid pump diaphragm 310A is being compressed to pump fluid.

Similarly, one-way air outlet valves 323B, 323C are shown transparently to more clearly illustrate the flow of air 331B, 331C through air outlet apertures 309B, 309C and into mixing chamber 325. One-way air outlet valves 323B, 323C each include a valve stem 357B, 357C (FIG. 3) that are inserted into corresponding apertures 329B, 329C to secure the one-way air outlet valves to valve seat 308. One-way air outlet valves 323B, 323C are normally closed and prevent air or liquid from flowing from the mixing chamber 325, back through air outlet apertures 323B, 323C, and into air pump diaphragms 310B, 310C. One-way air outlet valves 323B, 323C open when corresponding air pump diaphragms 310B, 310C are being compressed to pump air.

The valve seat 308 also includes flow directional control walls 308E. The flow directional control walls 308E provide flow paths that aid in the mixing of liquid and air. In this embodiment the flow directional control walls 308E are curved and cause the liquid and air to intersect in a tangential relationship. In some embodiments, flow directional control walls 308E are designed and arranged to cause the liquid an air to intersect at a desired angle, such as, for example, each flow path may intersect at a 120 degree angle. In some embodiments, the flow directional control walls 308E are arranged so that the two air paths intersect the liquid flow path at about 180 degrees. The design of the flow path intersection may be different for different types of liquids, for example, a higher quality of foam may be obtained by causing the liquid soap to be intersected head on (180 degrees) by the two air flow paths, while a higher quality foam may be obtained for foamable sanitizer by having the air paths tangentially intersect with the liquid path.

Figure 8:
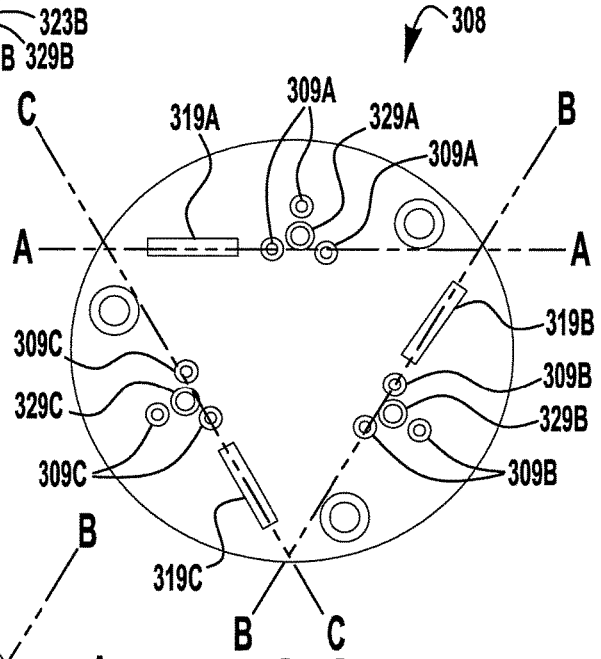
FIG. 8 is a bottom view of the exemplary valve seat of FIG. 7.

FIG. 8 is a bottom view of the exemplary valve seat 308 for the foam pump 206. The valve seat 308 includes three liquid outlet apertures 309A that pass through valve seat 308 and a liquid outlet valve aperture 329A for retaining one-way liquid outlet valve 323A. Valve seat 308 also includes a liquid inlet groove 319A that extends partially into valve seat 308 to provide a liquid path from one-way liquid inlet valve 316A to the interior of liquid pump diaphragm 310A. In addition, the valve seat 308 includes a first set of three air outlet apertures 309B that pass through valve seat 308, and a second set of three air outlet apertures 309C that pass through valve seat 308. Also, valve seat 308 includes air outlet valve apertures 329B, 329C for retaining one-way air outlet valves 323B, 323C, and air inlet grooves 319B, 319C that extend partially into valve seat 308 to provide an air path from one-way air inlet valves 316B, 316C to the interior of air pump diaphragms 310B, 310C.

Figure 9:
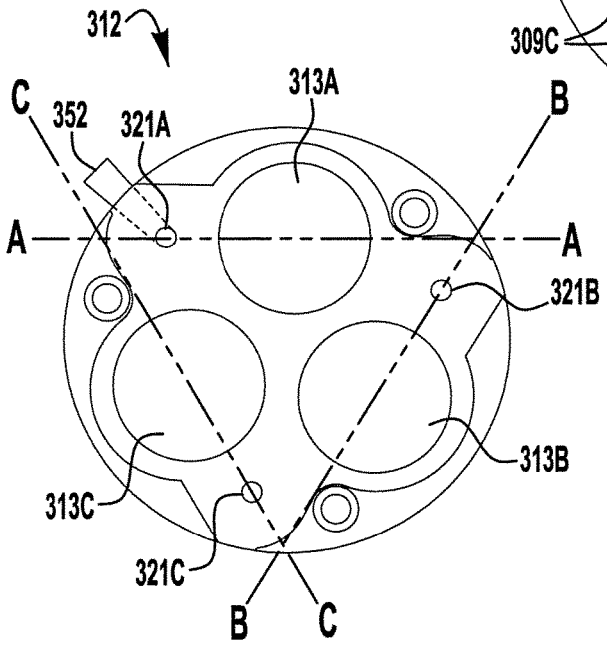
FIG. 9 is a top view of an exemplary diaphragm assembly seat for the exemplary embodiment of the sequentially activated multi-diaphragm foam pump of FIG. 3.

FIG. 9 is a top view of an exemplary diaphragm assembly seat 312 for the exemplary embodiment of a foam pump 206. The diaphragm assembly seat 312 includes three receiving holes 313A, 313B, 313C and three inlet apertures 321A, 321B, 321C. In fluid communication with inlet aperture 321A is liquid inlet 352 which may be coupled to the liquid outlet of container 102. Each receiving hole 313A, 313B, 313C is sized to receive a diaphragm 310A, 310B, 310C. Each inlet aperture 321A, 321B, 321C extends through diaphragm assembly seat 312 and allows either ambient air, liquid soap, or sanitizer to enter one of the diaphragms 310A, 310B, 310C.

Figure 10A:
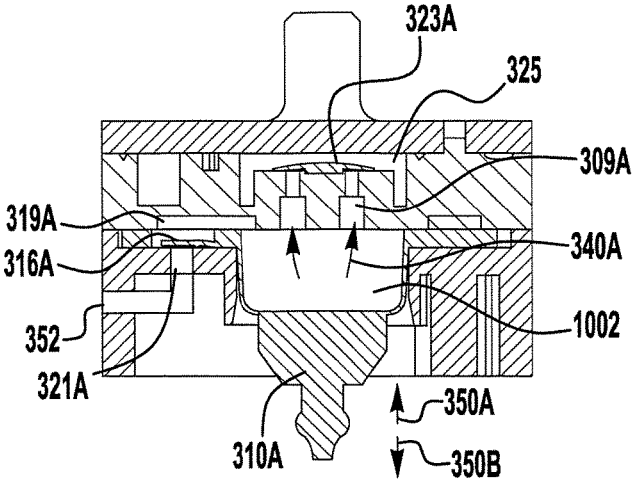
FIG. 10A is a cross-sectional view taken along the lines A-A of FIGS. 5-9 of a liquid pump portion of the sequentially activated multi-diaphragm foam pump of FIG. 3.

FIG. 10A is a cross-sectional view taken along the lines A-A of FIGS. 5-9 showing the liquid pump portion of foam pump 206. In operation, liquid pump diaphragm 310A is moved downward, as shown by reference number 350B, to expand pump chamber 1002, which causes liquid inlet valve 316A to open allowing liquid to be drawn into pump chamber 1002 through liquid inlet 352, inlet aperture 321A, and liquid inlet groove 319A. Once the pump chamber 1002 is expanded it is primed with liquid, such as, for example, liquid soap or sanitizer. When the liquid pump diaphragm 310A is compressed (i.e. the liquid pump diaphragm 310A moves in the direction shown by reference number 350A), the liquid is pumped in the direction shown by reference number 340A. The liquid travels through liquid outlet apertures 309A, past one-way liquid outlet valve 323A and into mixing chamber 325. One-way liquid outlet valve 323A is normally closed, but one-way liquid outlet valve 323A opens due to pressure caused by compressing liquid pump chamber 1002. One-way liquid outlet valve 323A prevents air or liquid from flowing back through liquid outlet apertures 309A and into liquid pump diaphragm 310A. Subsequently, the liquid pump diaphragm 310A begins to expand, which starts the process again by causing liquid inlet valve 316A to open, and liquid is drawn into liquid pump chamber 1002 through liquid inlet aperture 321A and liquid inlet groove 319A. A operating cycle of foam pump 206 includes one pump of liquid from liquid pump diaphragm 310A through liquid outlet apertures 309A, past liquid outlet valve 323A, and into mixing chamber 325 (FIG. 7) (followed by two pumps of air as described below).

Figure 10B:
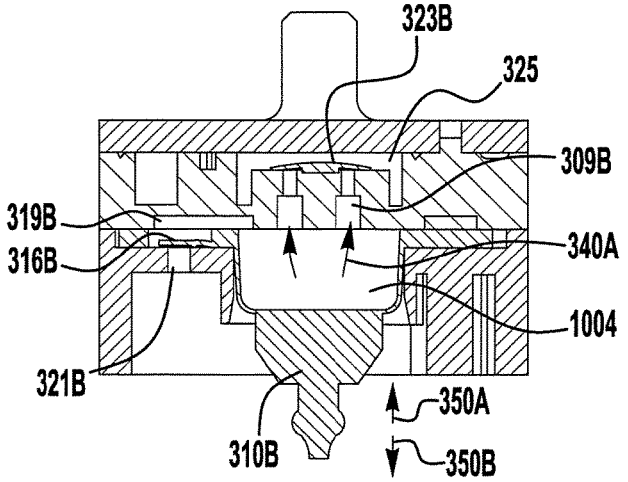
FIG. 10B is a cross-sectional view taken along the lines B-B of FIGS. 5-9 of a first air pump portion of the sequentially activated multi-diaphragm foam pump of FIG. 3.
Figure 10C:
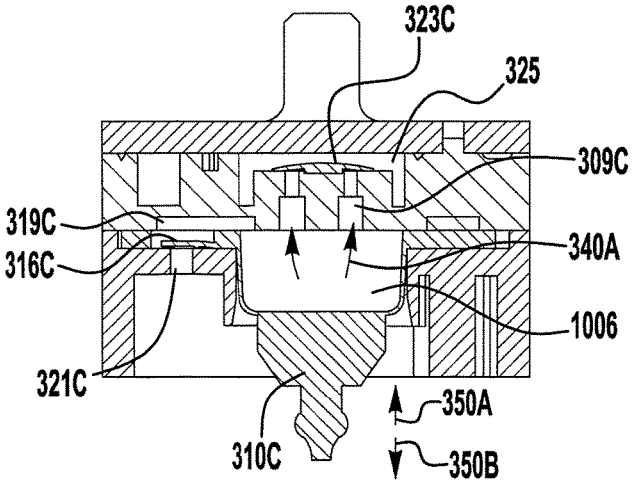
FIG. 10C is a cross-sectional view taken along the lines C-C of FIGS. 5-9 of a second air pump portion of the sequentially activated multi-diaphragm foam pump of FIG. 3.

FIGS. 10B and 10C are a cross-sectional view taken along the lines B-B and C-C, respectively, of FIGS. 5-9 showing the air pump portions of foam pump 206. In operation, air pump diaphragms 310B, 310C are moved downward, as shown by reference number 350B, to expand air pump chambers 1004, 1006, which causes air inlet valves 316B, 316C to open allowing ambient air to be drawn into pump chambers 1004, 1006 through air inlet apertures 321B, 321C and air inlet grooves 319B, 319C. Once the pump chambers 1004, 1006 are primed with air, the air pump diaphragms 310B, 310C may be compressed (moved in the direction shown by reference number 350A). Compression of air pump diaphragms 310B, 310C pump the air in the direction shown by reference number 340A. The air travels through air outlet apertures 309B, 309C, past one-way air outlet valves 323B, 323C, and into mixing chamber 325 to mix with the foamable liquid. One-way air outlet valves 323B, 323C are normally closed, but one-way air outlet valves 323B, 323C open due to pressure caused by compressing air pump chambers 1004, 1006. One-way air inlet valves 323B, 323C prevent air or liquid from flowing back through air outlet apertures 309B, 309C and into air pump diaphragms 310B, 310C. Subsequently, the air pump diaphragms 310B, 310C begin to expand, which starts the process again by causing air inlet valves 316B, 316C to open, and ambient air is drawn into air pump chambers 1004, 1006 through air inlet apertures 321B, 321C and air inlet grooves 319B, 319C. An operating cycle of foam pump 206 includes one pump of liquid (as described above) followed by one pump of air from air pump diaphragm 310B through air outlet apertures 309B, past air outlet valve 323B, and into mixing chamber 325 (FIG. 7). In addition, an operating cycle of foam pump 206 includes one pump of ambient air from air pump diaphragm 310C through air outlet apertures 309C, past air outlet valve 323C, and into mixing chamber 325 (FIG. 7).

The diaphragms 310A, 310B, 310C operate sequentially, in which one sequence of operation includes one pump of liquid, such as, for example, soap or sanitizer, or ambient air by each of the three pump diaphragms 310A, 310B, 310C. The order of operation of the pump diaphragms 310A, 310B, 310C is dependent upon the configuration of the wobble plate 314 (FIG. 3). As shown in FIG. 3, each pump diaphragm 310A, 310B, 310C has a connector 311A, 311B, 311C, and the three pump diaphragms 310A, 310B, 310C connect to the wobble plate 314 by inserting the three connectors 311A, 311B, 311C in the three wobble plate links 314A, 314B, 314C. Wobble plate 314 connects to an eccentric wobble plate actuator that causes the wobble plate 314 to undulate. As the wobble plate 314 undulates, the wobble plate links 314A, 314B, 314C move in upward and downward motions. The upward motion causes the pump diaphragms 310A, 310B, 310C to compress, and the downward motion causes the pump diaphragms 310A, 310B, 310C to expand. The configuration of the wobble plate 314 causes one pump diaphragm 310A, 310B, 310C to compress at a time, which causes the pump diaphragms 310A, 310B, 310C to pump sequentially. The configuration of the wobble plate 314 also causes one pump diaphragm 310A, 310B, 310C to expand at a time, which causes the pump diaphragms 310A, 310B, 310C to prime sequentially. In the exemplary sequence of operation, the liquid pump diaphragm 310A pumps a shot of fluid, followed by air pump diaphragm 310B pumping a shot of air, and the sequence of operation ends with air pump diaphragm 310C pumping a second shot of air. The sequence may be repeated any number of times depending on the desired output dose of foam. The air from the air pump diaphragms 310B, 310C mixes with either the liquid or sanitizer from the liquid pump diaphragm 310A in the mixing chamber 325 (FIG. 7), which creates a foam mixture. The foam mixture exits the foam pump 206 through the pump outlet 350.

FIG. 4 illustrates the flow path of the liquid soap or sanitizer through the exploded view. When the liquid pump diaphragm 310A expands, liquid enters the foam pump 206 through liquid inlet 352, which is shown by reference number 330A. The liquid travels through aperture 321A in the diaphragm assembly seat 312, and past liquid one-way inlet valve 316A, as shown by reference number 330B. Inlet valve 316A opens, the liquid travels through groove 319A and into liquid pump diaphragm 310A, which is shown by reference numbers 330D and 330E.

The liquid pump diaphragm 310A compresses and pumps the liquid through liquid outlet aperture 309A, past one-way liquid outlet valve 323A, and into the mixing chamber 325 (FIG. 7), which is shown by reference number 340A. Air follows a similar path for air pump diaphragms 310B, 310C. When air pump diaphragms 310B, 310C expand, air is drawn into air inlet 424B, travels through apertures 321B, 321C (FIG. 9) in diaphragm seat assembly 312, travels through one-way air inlet valves 316B, 316C (FIGS. 5 and 6), travels into grooves 319B, 319C, in the bottom of valve seat 308, and travels into air pump diaphragms 310B, 310C. When air pump diaphragms 310B, 310C compress, air is forced through apertures 309B, 309C, past one-way air outlet valves 323B, 323C (FIG. 7), and into mixing chamber 325 where it mixes with the liquid to form a foam mixture. The foam mixture is dispensed through outlet 350, which is shown by reference number 304B.

In some embodiments, the foam mixture has an air to liquid ratio of between about 7 to 1 and about 10 to 1. In some embodiments, the air to liquid ratio is greater than 10 to 1, and in some embodiments is less than 7 to 1.

In some exemplary embodiments, a flow control valve (not shown) is located between the container 102 of foamable liquid and pump 206. The flow control valve may be used to adjust the liquid to air ratio. If a higher liquid to air ration is desired, the flow control valve is set at a lower flow rate that starves the liquid pump diaphragm. Conversely, to increase the liquid to air ratio, the flow control valve may be opened wider allowing more liquid to flow into pump 206. In some embodiments, the liquid pump diaphragm 310A may have a different volume than the air pump diaphragms 310B, 310C to adjust the ratio of liquid to air. In some embodiments, the volume of the liquid pump diaphragm 310A is reduced by inserting a sponge (not shown) in the liquid pump diaphragm 310A. Not only does the sponge (not shown) reduce the volume, but in some embodiments, slows the flow of liquid through the liquid pump diaphragm 310A.

In some embodiments, it is desirable to have a higher air to liquid ratio and the foam pump may contain more than two air pump diaphragms, such as, for example, between about three and eight air pump diaphragms per liquid pump diaphragm. In such embodiments, it may be possible to have air to liquid rations of between about 10 and 50.

Figure 11:
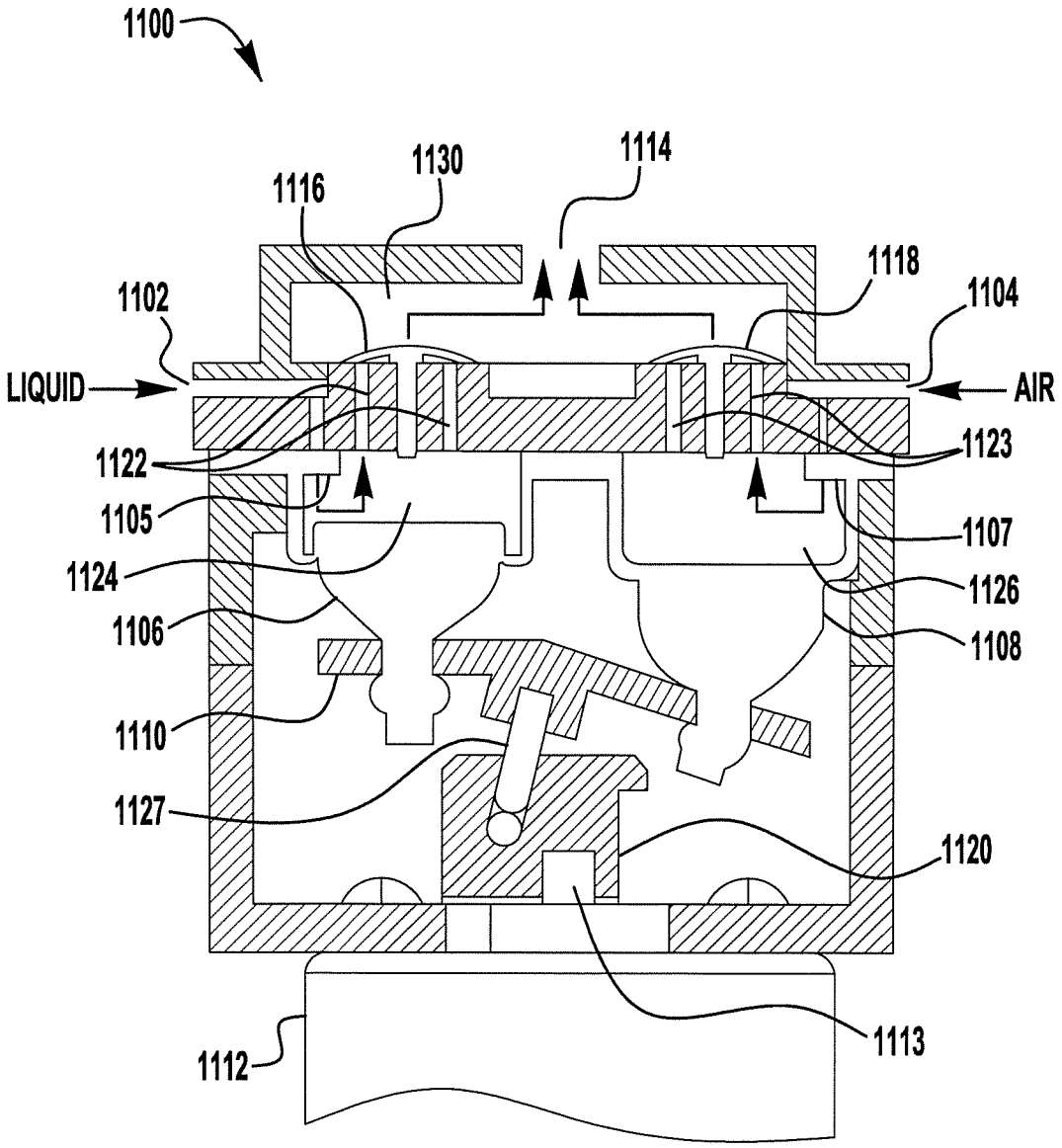
FIG. 11 is a cross-sectional view of another exemplary embodiment of a sequentially activated multi-diaphragm foam pump.

FIG. 11 is a cross-sectional view of another exemplary embodiment of a sequentially activated multi-diaphragm foam pump 1100. The sequentially activated multi-diaphragm foam pump 1100 includes a motor 1112, a motor shaft 1113, a wobble plate 1110, a wobble plate pin 1127 an eccentric wobble plate drive 1120, a liquid pump diaphragm 1106, two air pump diaphragms 1108 (only one is shown), mixing chamber 1130, and pump outlet 1114. The motor 1112 drives the motor shaft 1113, which causes the motor shaft 1113 to rotate. The rotation of the motor shaft 1113 causes the eccentric wobble plate drive 1120 to rotate, and rotation of the eccentric wobble plate drive 1120 causes the wobble plate pin 1127 to move along a circular path, which causes the wobble plate 1110 to undulate. In some embodiments, wobble plate 314 includes a ball 1128 that rides in a socket (not shown) on the pump housing and wobble plate pin 127 extends outward and connects to an eccentric wobble plate actuator 1120 that causes the pin to move along a circular path which causes the wobble plate 1110 to undulate. As the wobble plate 1110 undulates, the ends connected to the three pump diaphragms 1106, 1108 move in upward and downward motions, and the three pump diaphragms 1106, 1108 are compressed sequentially. One sequence of operation of the mixing pump 1100 includes one pump by each of the three pump diaphragms 1106, 1108. The liquid pump diaphragm 1106 operates first in the cycle of operation, followed by sequential distributions by the two air pump diaphragms 1108.

Similar to the embodiments described above, during operation, the liquid pump diaphragm 1106 expands and contracts to pump liquid, and the air pump diaphragms 1108 (only one is shown) expand and contract to pump air. The expansion of the liquid pump diaphragm 1106 opens the liquid inlet valve 1105 and allows liquid, such as, for example, soap or sanitizer to enter liquid pump chamber 1124 through liquid inlet 1102. The expansion of the air pump diaphragms 1108 opens the air inlet valves 1107 (only one is shown) and allows air to enter air pump chambers 1126 (only one is shown) through air inlets 1104. Circular movement of the wobble plate pin 1127 causes the ends of the wobble plate 1110 to sequentially undulate. The undulation causes liquid pump diaphragm to compress, which causes liquid outlet valve 1116 to open, and liquid to flow into the mixing chamber 1130 through liquid outlet apertures 1122. Subsequently, one of the air pump diaphragms 1108 is compressed by the undulating wobble plate 1110, which causes air outlet valve 1118 to open, and air to flow the mixing chamber 1130 through air outlet apertures 1123. Then, the other air pump diaphragm (not shown) will compress and pump air into mixing chamber 1130. The air and liquid soap or sanitizer mix in the mixing chamber 1130 to create a foam mixture. The foam mixture exits the mixing pump 1100 through pump outlet 1114.

Figure 12:
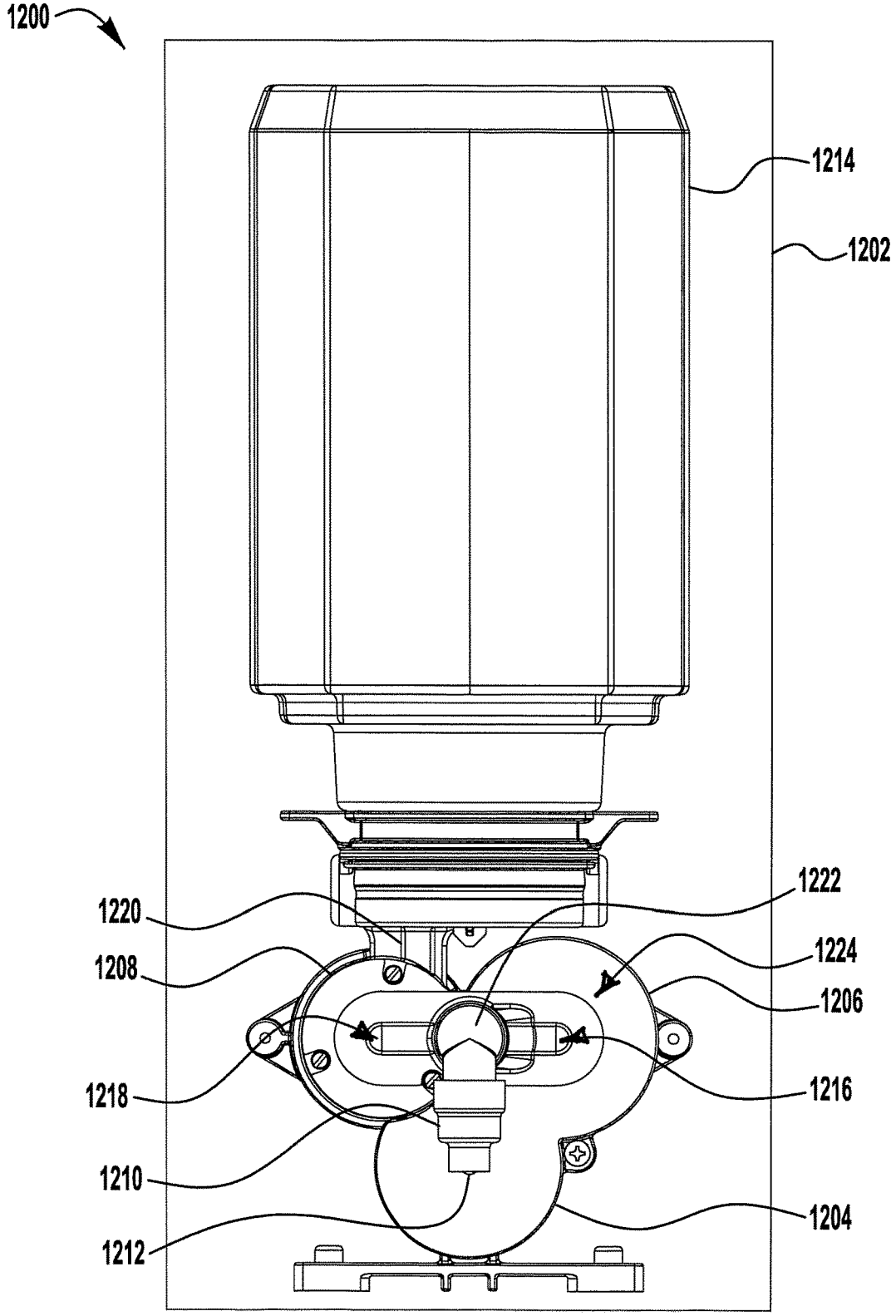
FIG. 12 is another exemplary embodiment of a foam dispenser.

FIG. 12 is another exemplary embodiment of a foam dispenser 1200. The foam dispenser 1200 includes a housing 1202, a container 1214 for holding a foamable liquid, a motor 1204, an air pump 1206, a foam pump 1208, and an outlet component 1224. The foam pump 1208 is in fluid communication with container 1214 via inlet passage 1220 and the outlet component 1224. As better seen in FIG. 16, the outlet component 1224 has a foam channel 1218, an air channel 1216, a second mixing chamber 1222, a foam cartridge 1210, and an outlet nozzle 1212. Foam pump 1208 is similar to the foam pumps previously described and has a liquid pump diaphragm and a plurality of air pump diaphragms. The foam pump 1208 and the air pump 1206 are driven by a drive shaft (not shown) and gear system (not shown) powered by motor 1204. When motor 1204 is activated, foam pump 1208 will draw in foamable liquid from container 1214 and mix it with air to form a first foam mixture. The first foam mixture is pumped through foam channel 1218 into second mixing chamber 1222. Air pump 1206 (which operates similar to the foam pumps described above, however all of the pump diaphragms pump air) will pump air through air channel 1216 into second mixing chamber 1222. The first foam mixture and air mix in second mixing chamber 1222 to create a second foam mixture. The second foam mixture travels through foam cartridge 1210 and is dispensed out of outlet nozzle 1212 as rich foam.

In some embodiments, the first mixture has an air to liquid ratio of about 7 to 1 to about 10 to 1. In some embodiments, the second mixture has an air to liquid ratio greater than 20 to 1, and, in other embodiments, the second mixture has an air to liquid ratio between about 30 to 1 and about 50 to 1.

Figure 13:
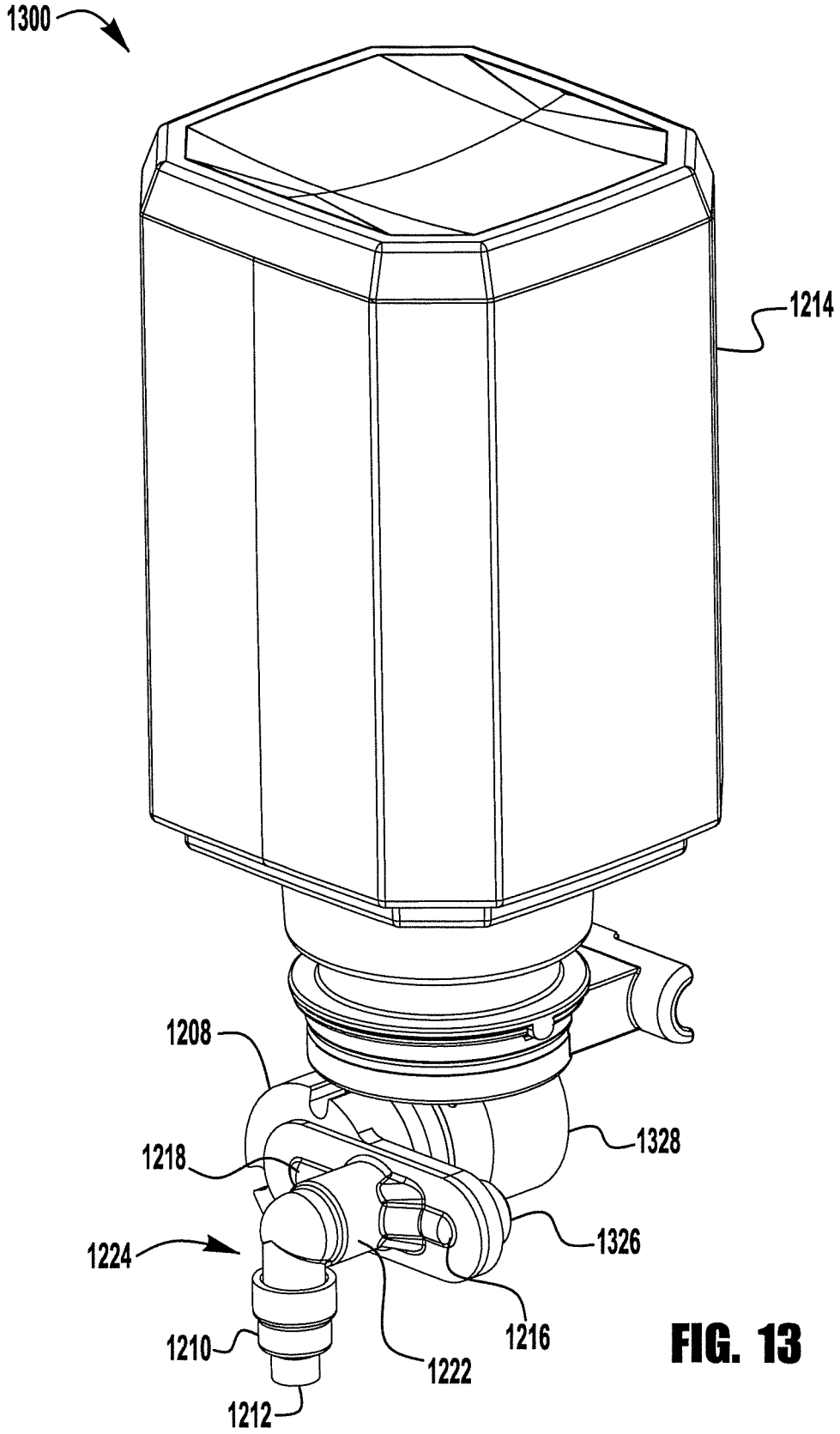
FIG. 13 is a perspective view of an exemplary embodiment of a refill unit for a foam dispenser.
Figure 16:
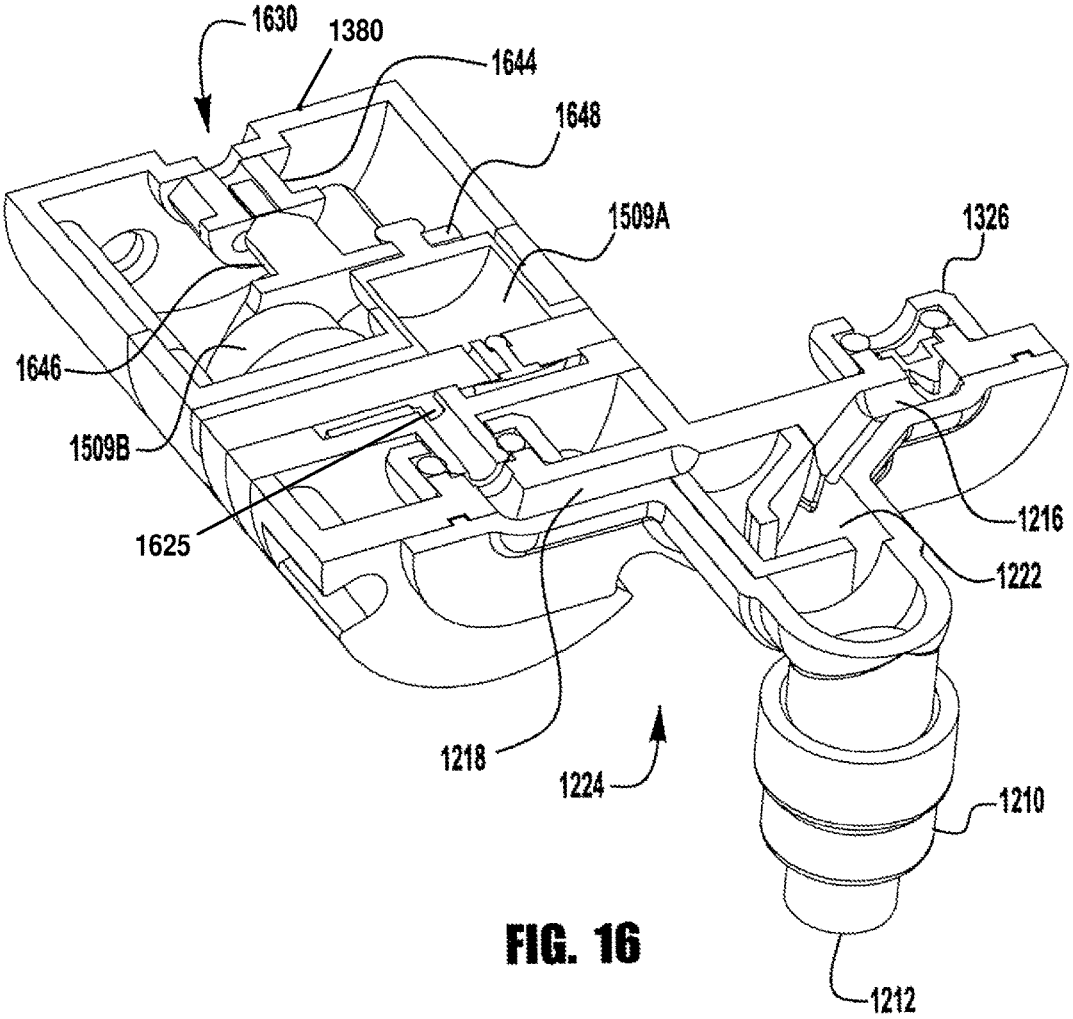
FIG. 16 is a cross-sectional perspective view of a portion of the exemplary refill unit of FIG. 13.

FIG. 13 is a perspective view of an exemplary embodiment of a refill unit 1300 for foam dispenser 1200. The refill unit 1300 includes container 1214, foam pump 1208, and outlet component 1224. The foam pump 1208 is in fluid communication with container 1214 and with outlet component 1224. The outlet component 1224 includes connector 1326, foam channel 1218 (some of the components are best seen in FIG. 16), air channel 1216, second mixing chamber 1222, foam cartridge 1210, and outlet nozzle 1212.

Figure 14:
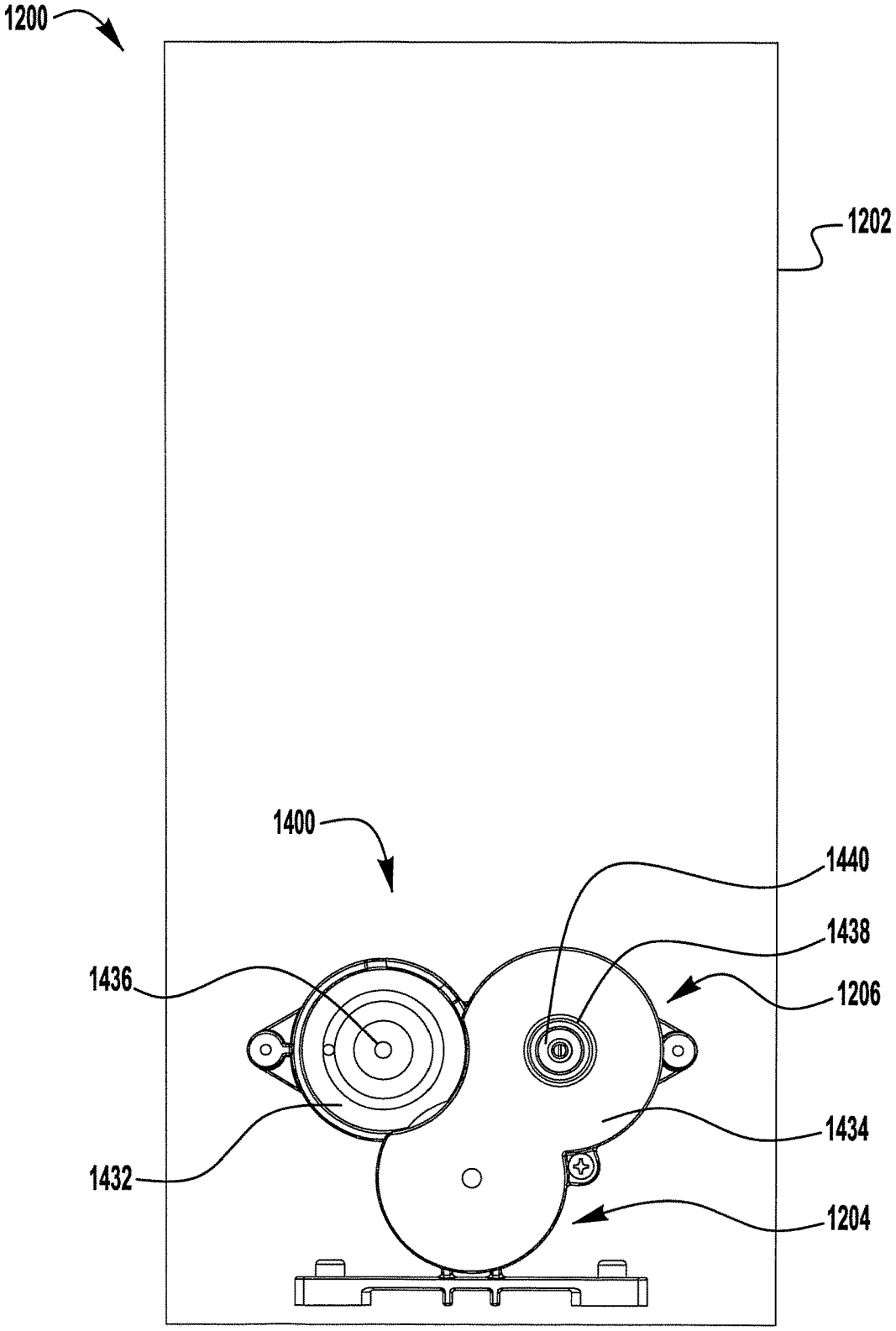
FIG. 14 is the exemplary embodiment of the foam dispenser of FIG. 12 without the refill unit of FIG. 13 installed.

FIG. 14 is the exemplary foam dispenser 1200 of FIG. 12 without the refill unit 1300 installed. The foam dispenser 1200 includes a support 1400 that permanently retains air pump 1206 and motor 1204. Support 1400 includes a socket 1432 for receiving the foam pump 1208 of refill unit 1300. The socket 1432 has a drive shaft 1436 extending outward.

Support 1400 also has a cover 1434 that covers the motor 1204 and the air pump 1206. The portion of the cover 1434 that covers the air pump 1206 has an air outlet aperture 1440. The connector 1326 of the outlet component 1224 is releasably attachable to the air outlet aperture 1440 of air pump 1206. When refill unit 1300 is installed in dispenser 1200, connector 1326 (which is a male connector) of outlet component 1224 attaches to air pump connector 1438 and places air pump 1206 is in fluid communication with second mixing chamber 1222 through air channel 1216. Preferably connector 1326 and air pump connector 1438 provide an airtight connection. When the refill unit 1300 is not installed in dispenser 1200, air outlet aperture 1440 is open to the atmosphere.

Foam pump 1208 has a housing 1328 that has an aperture 1630 (FIG. 16) on the back side. Foam pump 1208 is releasably attachable to the drive shaft 1436 which is powered by motor 1204 by sliding aperture 1630 and eccentric wobble plate drive 1644 over the shaft 1436 of the motor.

Figure 15:
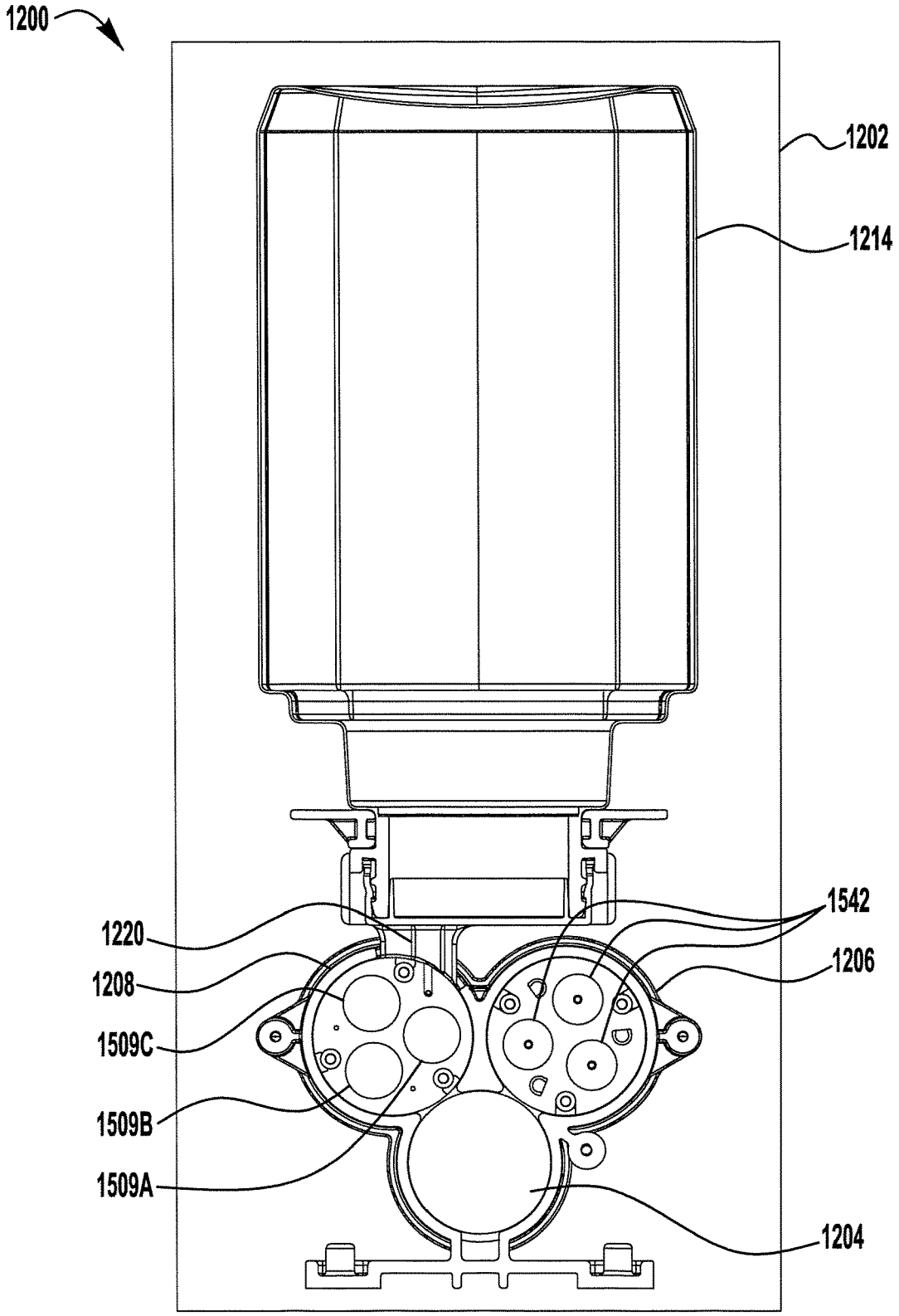
FIG. 15 is a cross-sectional view of a portion of the exemplary foam dispenser of FIG. 12 showing an exemplary foam pump and an exemplary air pump.

FIG. 15 is a partial cross-sectional view of the exemplary foam dispenser 1200 of FIG. 12 showing an exemplary foam pump 1208 and an exemplary air pump 1206. The foam pump has a liquid pump diaphragm 1509A and two air pump diaphragms 1509B, 1509C. The liquid pump diaphragm 1509A and air pump diaphragms 1509B, 1509C may take the form of any pump diaphragm, such as for example, any of the pump diaphragms described herein. The liquid pump receives foamable liquid from the container 1214 through liquid inlet 1220. Pump diaphragms 1509A, 1509B, 1509C operate sequentially. In some embodiments, the sequential operations starts with a shot of liquid from the liquid pump diaphragm 1509A, followed by a shot of air from each of the two air pump diaphragms 1509B, 1509C. In another embodiment, the pump diaphragms 1509A, 1509B, 1509C operate simultaneously. In both of the above-mentioned embodiments, the liquid and air that are pumped from the corresponding pump diaphragms 1509A, 1509B, 1509C mix in a first mixing chamber 1625 (FIG. 16) to form a first foam mixture. The first foam mixture travels through foam channel 1218 and into second mixing chamber 1222.

In some embodiments, the foam pump 1208 has four diaphragms, one diaphragm pumps liquid, and three diaphragms pump air. In some embodiments, the foam pump 1208 has more than four diaphragms. In some embodiments, the foam pump 1208 has a plurality of diaphragms that pump liquid and a plurality of diaphragms the pump air.

In this exemplary embodiment, air pump 1206 has three air pump diaphragms 1542. Air pump diaphragms 1542 of the air pump 1206 operate sequentially. In some embodiment, the air pump diaphragms 1542 operate simultaneously. The air from the air pump diaphragms 1542 travels through air channel 1216 and into second mixing chamber 1222 to mix with the first foam mixture, thereby forming the second foam mixture.

FIG. 16 is a cross-sectional perspective view of an exemplary foam pump 1208 and an exemplary outlet component 1224 of the exemplary refill unit 1300 of FIG. 13. Foam pump 1208 includes aperture 1630, eccentric wobble plate drive 1644, wobble plate pin 1646 (connected to an off-center aperture in wobble plate drive 1644, wobble plate 1648, pump diaphragms 1509A, 1509B, 1509C (not shown) and first mixing chamber 1625. A drive shaft (not shown) that is powered by motor 1204 through a gear system (not shown) is inserted through aperture 1630 and connects to the center of eccentric wobble plate drive 1644. When the motor 1204 is activated, the drive shaft rotates, which causes the eccentric wobble plate drive 1644 to rotate. When the eccentric wobble plate drive 1644 rotates, the wobble plate pin 1646 moves in a circular motion, which causes the wobble plate 1648 to undulate. As the wobble plate 1648 undulates, the pump diaphragms 1509A, 1509B, 1509C are sequentially operated. An operating cycle (or revolution) of the foam pump starts with a shot of liquid from liquid pump diaphragm 1509A, followed by a shot of air from air pump diaphragm 1509B, followed by a second shot of air from air pump diaphragm 1509C. The liquid from liquid pump diaphragm 1509A mixes with the air from air pump diaphragms 1509B, 1509C in first mixing chamber 1625 to create a first foam mixture.

The first foam mixture is pumped into outlet component 1224 through foam channel 1218. The first foam mixture travels through foam channel 1218 and enters second mixing chamber 1222. In addition, air from air pump 1206 flows into second mixing chamber 1222. The first foam mixture mixes with air from air pump 1206 that is pumped through air channel 1216 and into second mixing chamber 1222 and forms a second foam mixture. The second foam mixture travels through foam cartridge 1210 and is dispensed through outlet nozzle 1212 as rich foam.

The above-mentioned embodiments for the foam pump 1208 and air pump 1206 are only exemplary. The foam pump 1208 may have one or more liquid pump diaphragms and one or more air pump diaphragms Alternatively, the foam pump 1208 may have a liquid pump portion that includes another type of liquid pump that pumps small quantizes of foamable liquid, such as, for example, a piston pump. Similarly, the foam pump 1208 may have an air pump portion that includes two or more other types of pumps, such as piston pumps that pump small amounts of air. The air pump 1206 may have one or more air pump diaphragms. Alternatively, the air pump may have a plurality of other types of pump members, such as, for example, piston or dome pumps that pump small quantities of air.

In some embodiments, one pump having four or more diaphragms is used to produce a foam that has a high air to liquid ratio. In such embodiments, at least three diaphragms pump air with at least one diaphragm pumping liquid. In such embodiments, the pump is capable of providing a foam with an air to liquid ratio of about 10 to 1, of about 15 to 1, of about 20 to 1, of about 30 to 1, or even greater than a 30 to 1 air to liquid ratio.

The above disclosed foam dispensers systems having a foam pump that includes a liquid pump diaphragm and two or more air pump diaphragms that mix together in a first mixing chamber and then mix with air from a second pump at a second mixing chamber has been found to work very well with concentrated soap. Similarly, the above foam pump systems having at least four pump diaphragms with at least three of those pump diaphragms pumping air have been found to work very well with concentrated soap. The concentrated soap has a greater efficacy than standard foamable soaps which allows a user to use less of the concentrated soap to provide the desired results. It has been found, however, that because users are accustomed to a certain size dose, in some cases users do not believe the smaller dose is sufficient to achieve the desired results. Accordingly, it is desirable to give the appearance of a larger dose of concentrated soap when dispensing concentrated soap. Conventional foam dispensing pumps provide a foam with a liquid to air ratio of about 7 to 1. Foaming a efficacious dose of concentrated soap (which has a smaller volume of liquid than an efficacious dose of conventional foam soap) at an air to liquid ratio of 7 to 1 does not provide users with a visual dose size that appears to be efficacious. The embodiments described herein may be used to provided foams that have an air to liquid ratio of over 20 to 1, including over 30 to 1, including over 40 to 1 and including up to about 50 to 1. An efficacious dose of concentrated soap foamed with these ratios provide a user with a visual dose size that appears visually to be efficacious.

Figure 17A:
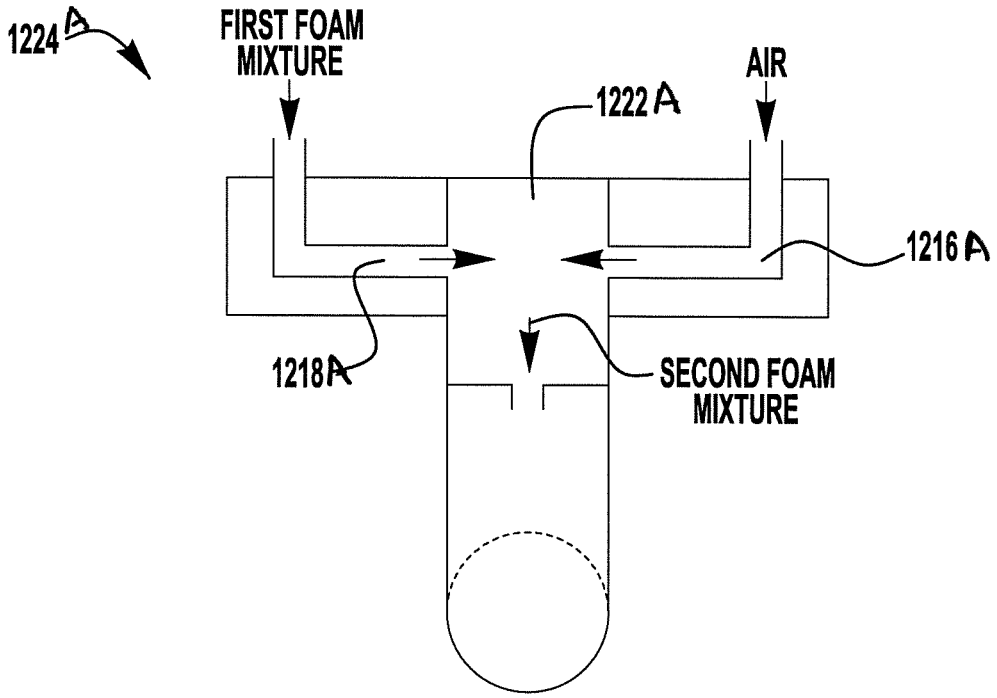
FIGS. 17A-17D are exemplary embodiments of second mixing chambers and outlets.
Figure 17B:
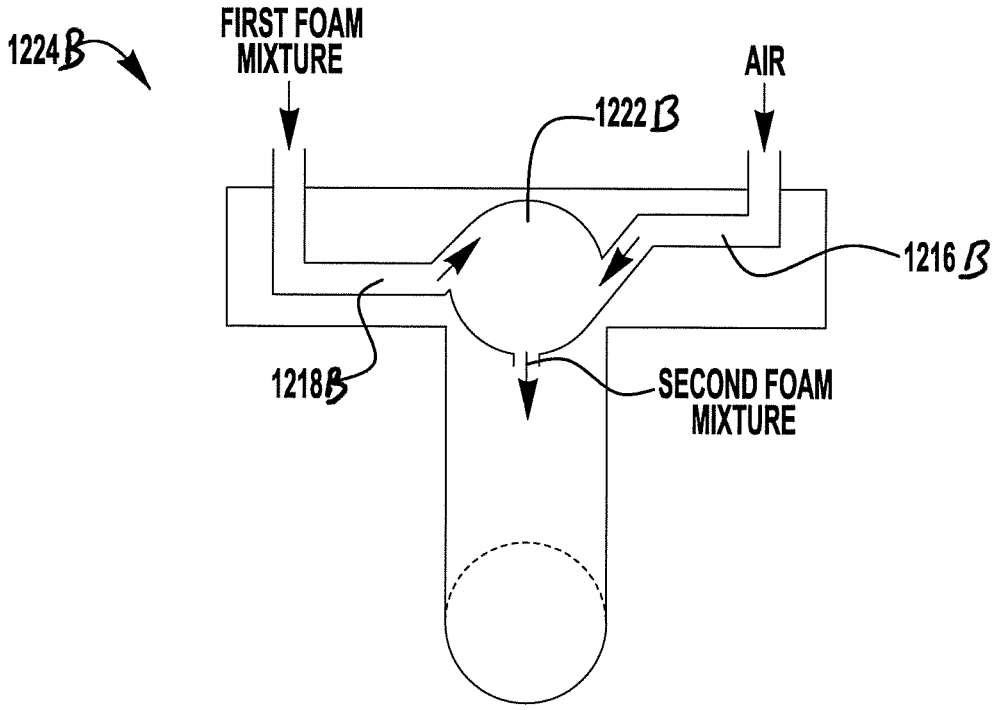
Figure 17C:
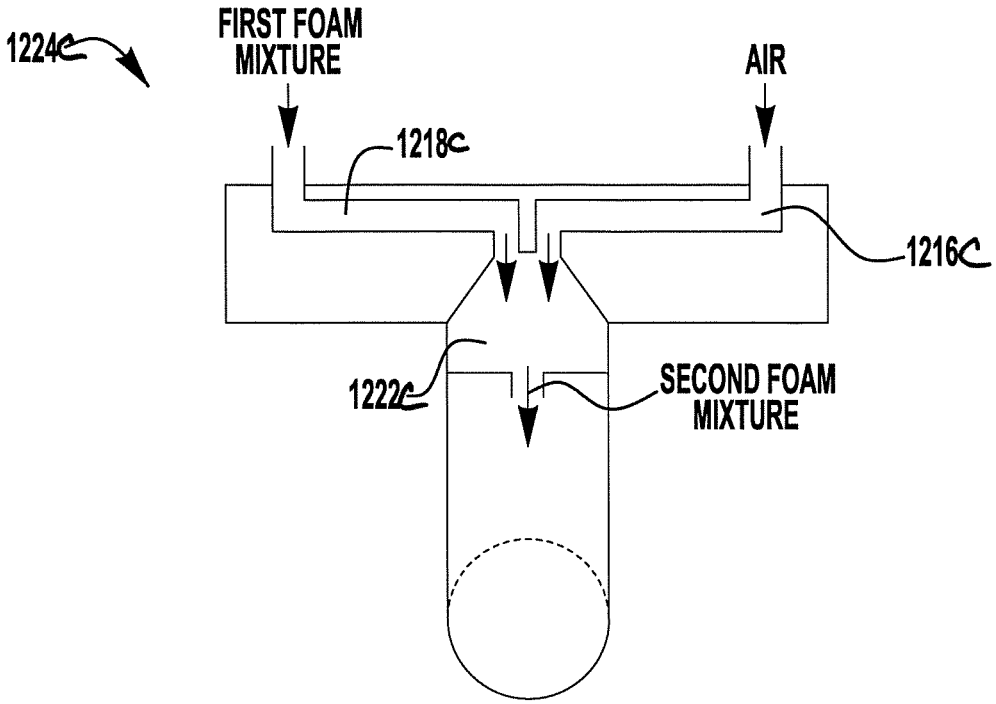
Figure 17D:
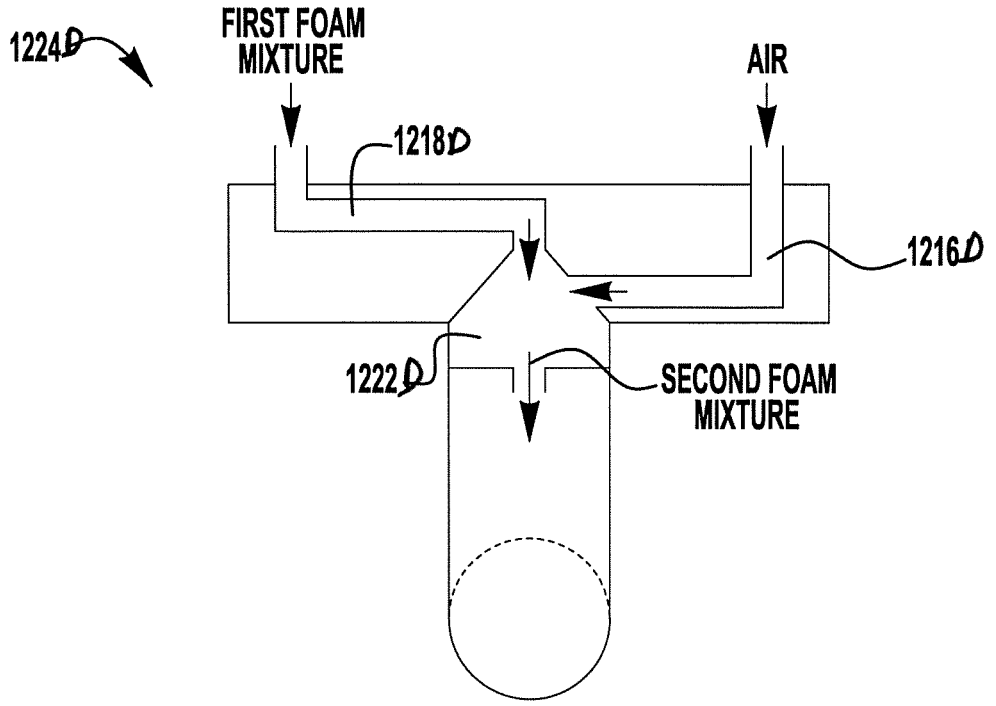

FIGS. 17A-17D are exemplary embodiments of additional outlet components 1224A, 1224B, 1224C and 1224D illustrating some exemplary alternative directions in which the first foam mixture and air may be directed into the second mixing chamber. Some of these alternative embodiments may be better suited for various foamable liquid compositions. For example, it may be desirable to have a more violent collision of the fluids, or a less violent collision of fluids. The directions in which the first foam mixture and air enter the second mixing chamber affects the characteristics of the second foam mixture because the different directions will cause a different level of turbulence created by the air in the first foam mixture. In some embodiments, as shown in FIG. 17A, the first foam mixture 1218A and the air 1216A may enter the second mixing chamber 1222A in substantially opposite directions. In another embodiment, as shown in FIG. 17B, the air 1216B may enter the second mixing chamber 1222B in a tangential direction to the first foam mixture 1218B. In another embodiment, as shown in FIG. 17C, the first foam mixture 1218C and the air 1216C may enter the second mixing chamber 1222C in a substantially parallel direction. In another embodiment, as shown in FIG. 17D, the air 1216D may enter the second mixing chamber 1222D in a direction that is perpendicular to the direction that the first foam mixture 1218D enters the second mixing chamber 1222D. The above-mentioned embodiments are only exemplary. The outlet component 1224 may have any configuration that allows the first foam mixture to mix with air in the second mixing chamber 1222.

The electronically driven exemplary sequentially activated diaphragm foam pumps disclosed herein generate about 2 to 3 times as much pressure as standard piston foam pumps used in conventional touch-free foam soap and sanitizer dispensers. Exemplary embodiments of the electronically driven exemplary sequentially activated diaphragm foam pumps disclosed herein generate greater than about 4 pounds per square inch ("psi"). In some exemplary embodiments, the sequentially activated diaphragm foam pumps disclosed herein generate greater than about 5 pounds per square inch ("psi"). In some exemplary embodiments, the sequentially activated diaphragm foam pumps disclosed herein generate greater than about 6 pounds per square inch ("psi"). In some exemplary embodiments, the sequentially activated diaphragm foam pumps disclosed herein generate greater than about 7 pounds per square inch ("psi"). In some exemplary embodiments, the sequentially activated diaphragm foam pumps disclosed herein generate greater than about 8 pounds per square inch ("psi"). In some exemplary embodiments, the sequentially activated diaphragm foam pumps disclosed herein generate greater than about 9 pounds per square inch ("psi"). In some exemplary embodiments, the sequentially activated diaphragm foam pumps disclosed herein generate greater than about 10 pounds per square inch ("psi"). In some exemplary embodiments, the sequentially activated diaphragm foam pumps disclosed herein generate greater than about 11 pounds per square inch ("psi"). In some exemplary embodiments, the sequentially activated diaphragm foam pumps disclosed herein generate greater than about 12 pounds per square inch ("psi"). In some exemplary embodiments, the sequentially activated diaphragm foam pumps disclosed herein generate greater than about 13 pounds per square inch ("psi"). In some exemplary embodiments, the sequentially activated diaphragm foam pumps disclosed herein generate greater than about 14 pounds per square inch ("psi"). In some exemplary embodiments, the sequentially activated diaphragm foam pumps disclosed herein generate greater than about 15 pounds per square inch ("psi"). It has been discovered that using a 4-diaphragm pump with one diaphragm pumping foaming liquid and three pump diaphragm creates working pressures ranging from between about 12-17 psi. Working pressures were measured at the point of the liquid air mixing and is the pressure generated once the pump is moving at a steady speed (after the ramp up).

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

The invention claimed is:

1. A foam dispenser comprising:
a housing;
a container for holding foamable liquid;
a motor;
an air pump;
a foam pump having:
a liquid pump portion that pumps liquid;
an air pump portion that pumps air;
a first mixing chamber located downstream of the liquid pump portion and the air pump portion for mixing the liquid from the liquid pump portion with the air from air pump portion to create a first foam mixture;
a second mixing chamber located downstream of the first mixing chamber and the air pump for mixing the first foam mixture from the foam pump with air from the air pump to create a second foam mixture;
a foam cartridge; and
an outlet for dispensing foam.

2. The foam dispenser of claim 1 wherein the first foam mixture has an air to liquid ratio of greater than about 2 to 1.

3. The foam dispenser of claim 1 wherein the second foam mixture has an air to liquid ratio of greater than 10 to 1.

4. The foam dispenser of claim 1 wherein the second foam mixture has an air to liquid ratio greater than about 20 to 1.

5. The foam dispenser of claim 1
wherein the liquid pump portion of the foam pump includes at least one liquid pump diaphragm and
wherein the air pump portion of the foam pump includes at least two air pump diaphragms.

6. The foam dispenser of claim 1 wherein an operating cycle of the foam pump includes a shot of liquid followed by two or more shots of air.

7. The foam dispenser of claim 1 wherein the air pump portion comprises a plurality of air pump diaphragms.

8. The foam dispenser of claim 1 wherein the container and the foam pump form a refill unit and the refill unit is removable from the foam dispenser without removing the air pump.

9. The foam dispenser of claim 1 wherein the air pump includes a wobble plate and the foam pump includes a wobble plate.

10. The foam dispenser of claim 1 wherein the first foam mixture enters the second mixing chamber in a first direction and air from the air pump enters the second mixing chamber in substantially the opposite direction.

11. The foam dispenser of claim 1 wherein the first foam mixture enters the second mixing chamber in a first direction and air from the air pump enters the second mixing chamber tangentially to the first direction.

12. The foam dispenser of claim 1 wherein the first foam mixture enters the second mixing chamber in a first direction and air from the air pump enters the second mixing chamber in a direction substantially perpendicular to the first direction.

13. The foam dispenser of claim 1 wherein the motor drives the air pump and the foam pump.

14. A foam dispenser comprising:
a housing;
a motor;
an air pump secured to the housing wherein the air pump has an air pump outlet;
a removable and replaceable refill unit wherein the refill unit includes:
a container for holding a foamable liquid;
a foam pump having:
a liquid pump portion that pumps liquid;
an air pump portion that pumps air;
a first mixing chamber located downstream of the liquid pump portion and the air pump portion for mixing the liquid from the liquid pump portion with the air from air pump portion to create a first foam mixture;
an air inlet for receiving air from the air pump;
a second mixing chamber located downstream of the first mixing chamber of the foam pump and in fluid communication with the air inlet for mixing the first foam mixture with air from the air pump;
a foam cartridge; and
an outlet for dispensing foam;
wherein the refill unit is releasably attachable to the air pump in a manner that allows the air pump outlet to be in fluid communication with the second mixing chamber of the refill unit when the refill unit is inserted in the foam dispenser.

15. The refill unit of claim 14 wherein the foam pump comprises a first liquid pump diaphragm, a first air pump diaphragm and a second air pump diaphragm.

16. The refill unit of claim 15 further comprising a wobble plate connected to the first liquid pump diaphragm, the first air pump diaphragm and the second air pump diaphragm.

17. The refill unit of claim 15 further comprising a foam pump drive, wherein the foam pump drive is an eccentric drive mechanism.

18. A foam dispenser for dispensing foam having an air to liquid ratio of greater than about 15 to 1 comprising:

a housing;

a motor located within the housing a holder for retaining a container with a foamable liquid;

a container with foamable liquid;

a foam pump;

the foam pump having a liquid pump diaphragm, and at least three air pump diaphragms;

a mixing chamber located downstream of the liquid pump diaphragm and the at least three air pump diaphragms; and an outlet;

wherein the liquid pump diaphragm and the at least three air pump diaphragms are operated sequentially.

19. The dispenser of claim 18 wherein the foam pump creates a working pressure of greater than about 10 pounds per square inch.

20. The dispenser of claim 18 wherein the foam pump is connected to, and remains with, the dispenser and separates from the container when the container is removed from the dispenser.

* * * * *